US011162269B2

(12) United States Patent
Machida et al.

(10) Patent No.: US 11,162,269 B2
(45) Date of Patent: Nov. 2, 2021

(54) REBAR TYING TOOL

(71) Applicant: MAKITA CORPORATION, Anjo (JP)

(72) Inventors: Yoshitaka Machida, Anjo (JP); Tadasuke Matsuno, Anjo (JP)

(73) Assignee: MAKITA CORPORATION, Anjo (JP)

( * ) Notice: Subject to any disclaimer, the term of this patent is extended or adjusted under 35 U.S.C. 154(b) by 332 days.

(21) Appl. No.: 16/098,466

(22) PCT Filed: May 11, 2017

(86) PCT No.: PCT/JP2017/017925

§ 371 (c)(1),
(2) Date: Nov. 2, 2018

(87) PCT Pub. No.: WO2017/199858

PCT Pub. Date: Nov. 23, 2017

(65) Prior Publication Data

US 2019/0093374 A1 Mar. 28, 2019

(30) Foreign Application Priority Data

May 20, 2016 (JP) ..... JP2016-101965

(51) Int. Cl.
*E04G 21/12* (2006.01)
*B21F 15/02* (2006.01)
(Continued)

(52) U.S. Cl.
CPC ..... *E04G 21/123* (2013.01); *B21F 15/06* (2013.01); *B65B 13/04* (2013.01); *B65B 13/187* (2013.01); *B65B 13/285* (2013.01)

(58) Field of Classification Search
CPC ..... B21F 15/02; B21F 15/04; B65B 13/025; B65B 13/04; B65B 13/14; B65B 13/08;
(Continued)

(56) References Cited

U.S. PATENT DOCUMENTS 5,657,799 A 8/1997 Kusakari et al.
5,944,064 A 8/1999 Saito et al.
(Continued)

FOREIGN PATENT DOCUMENTS

CN 1175929 A 3/1998
CN 203640307 U 6/2014
(Continued)

OTHER PUBLICATIONS

May 7, 2020 Office Action issued in Chinese Patent Application No. 201780031015.6.
(Continued)

*Primary Examiner* — Debra M Sullivan
(74) *Attorney, Agent, or Firm* — Oliff PLC

(57) ABSTRACT

A rebar tying tool may include a controller configured to selectively execute one of a plurality of control modes including a single-action control mode and a repetitive-action control mode. While the controller executes the single-action control mode, a tying mechanism may perform a tying operation in response to an activation of a manipulation member by a user. While the controller executes the repetitive-action control mode, the tying mechanism may perform the tying operation in response to a detection of the at least one of rebars by a detection mechanism.

6 Claims, 20 Drawing Sheets

(51) Int. Cl.

| | |
|---|---|
| ***B21F 15/06*** | (2006.01) |
| ***B65B 13/04*** | (2006.01) |
| ***B65B 13/18*** | (2006.01) |
| ***B65B 13/28*** | (2006.01) |

(58) Field of Classification Search
CPC ..... B65B 13/28; B65B 13/285; E04G 21/122; E04G 21/123
See application file for complete search history.

(56) References Cited

U.S. PATENT DOCUMENTS

| | | | |
|---|---|---|---|
| 6,401,766 | B1 | 6/2002 | Ishikawa et al. |
| 2003/0145900 | A1 | 8/2003 | Jensen et al. |
| 2015/0266082 | A1 | 9/2015 | Horn |

FOREIGN PATENT DOCUMENTS

| | | | |
|---|---|---|---|
| CN | 104640647 | A | 5/2015 |
| DE | 60109778 | T2 | 1/2006 |
| DE | 60022832 | T2 | 3/2006 |
| JP | H07-275983 | A | 10/1995 |
| JP | H08-114035 | A | 5/1996 |
| JP | H09-13677 | A | 1/1997 |
| JP | 2000-326918 | A | 11/2000 |
| JP | 2001-140471 | A | 5/2001 |
| JP | 2012-36722 | A | 2/2012 |
| JP | 2015-107554 | A | 6/2015 |

OTHER PUBLICATIONS

Sep. 23, 2020 Office Action issued in Japanese Patent Application No. 2016-101965.

Mar. 24, 2020 Office Action issued in Japanese Patent Application No. 2016-101965.

Aug. 1, 2017 International Search Report issued in International Patent Application No. PCT/JP2017/017925.

Aug. 1, 2017 Written Opinion issued in International Patent Application No. PCT/JP2017/017925.

Apr. 17, 2021 Office Action issued in German Patent Application No. 112017002596.6.

FIG. 10

| Control Mode | Activation Condition | |
|---|---|---|
| | Trigger | Rebar Detection |
| First Control Mode | Activated | — |
| Second Control Mode | — | Detected |

FIG. 13

| Control Mode | Activation Condition | |
|---|---|---|
| | Trigger | Rebar Detection |
| First Control Mode | Activated | — |
| Second Control Mode | — | Detected |
| Third Control Mode | Activated | Detected |

REBAR TYING TOOL

TECHNICAL FIELD

The technique disclosed herein relates to a rebar tying tool configured to tie a plurality of rebars with a wire.

BACKGROUND ART

Japanese Patent Application Publication No. 2001-140471 describes a rebar tying tool. This rebar tying tool is configured to perform a tying operation when a user activates a trigger. A control mode of such a rebar tying tool is called a single-action control mode, for example.

Japanese Patent Application Publication No. H09-13677 also describes a rebar tying tool. This rebar tying tool further includes a contact member configured to contact a plurality of rebars. The rebar tying tool is configured to perform a tying operation when a user activates a trigger and the contact member contacts the rebars. A control mode of such a rebar tying tool is called a repetitive-action control mode, for example.

SUMMARY OF INVENTION

Technical Problem

The conventional rebar tying tools are configured to perform the tying operation only when a preset single actuation condition is met. For example, the rebar tying tool of Japanese Patent Application Publication No. 2001-140471 is configured to perform the tying operation only when the user activates the trigger. The rebar tying tool of Japanese Patent Application Publication No. H09-13677 is configured to perform the tying operation only when the user activates the trigger and the contact member contacts the rebars. Normally, a rebar tying tool may be used in various tying work. However, according to the conventional rebar tying tools, the user needs to perform similar manipulations to meet the preset single actuation condition, regardless of an amount and content of the tying work. As a result, the conventional rebar tying tools are not capable of providing convenience in their usage depending on the amount and content of the tying work.

Solution to Technical Problem

The description herein discloses a rebar tying tool configured to tie a plurality of rebars with a wire. The rebar tying tool may comprise a tying mechanism comprising at least one motor and configured to perform a tying operation of tying the rebars with the wire, and a controller configured to control the at least one motor such that the tying mechanism performs the tying operation. The controller may be configured to selectively execute one of a plurality of control modes including a first control mode and a second control mode. While the controller executes the first control mode, the tying mechanism performs the tying operation when a first actuation condition is met. While the controller executes the second control mode, the tying mechanism performs the tying operation when a second actuation condition which is different from the first actuation condition is met.

According to the above rebar tying tool, the actuation conditions for the tying mechanism to perform the tying operation can be switched according to an amount and content of tying work, for example. The switching between the control modes which the controller executes may be performed according to an instruction or a manipulation by a user, or may automatically be performed by the controller.

BRIEF DESCRIPTION OF DRAWINGS

FIG. 10 is a table showing an actuation condition for a first control mode (that is, a first actuation condition) and an actuation condition for a second control mode (that is, a second actuation condition).

FIG. 13 is a table further showing an actuation condition for a third control mode (that is, a third actuation condition).

EMBODIMENTS OF THE INVENTION

Figure 1:
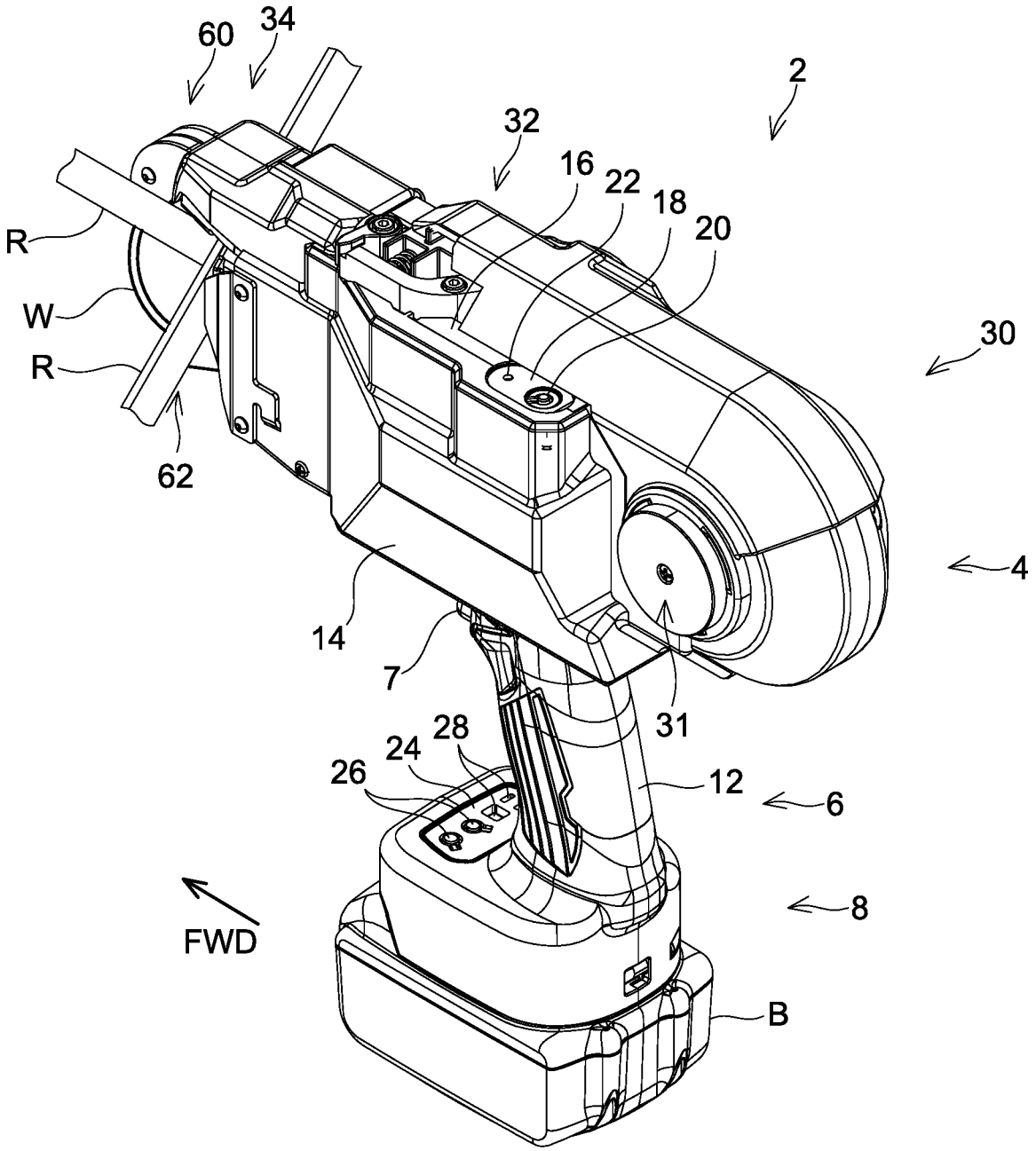
FIG. 1 is a perspective view seeing a rebar tying tool 2 from an upper-left rear side.

In one or more embodiments, a controller may be configured to switch a control mode to be executed according to an instruction or a manipulation by a user. According to such a configuration, the user can use a suitable control mode (that is, a suitable actuation condition) in accordance with an amount and content of tying work, for example. The instruction by the user is not particularly limited, however, it includes instructions by a condition which a rebar tying tool has been taught in advance (such as an operating time or operating number of times of the rebar tying tool) and by using external apparatus such as a smartphone. Further, the manipulation by the user is not particularly limited, however, it includes manipulations performed on various manipulation units or manipulation members provided in the rebar tying tool. The instruction by the user and the manipulation by the user are not strictly distinguished, and the instruction by the user may correspond to the manipulation by the user, and vice versa.

In one or more embodiments, the rebar tying tool may further comprise a manipulation member configured to be activated and deactivated by the user. In this case, while the controller executes a first control mode, a first actuation condition may be met when the manipulation member is activated by the user. That is, this means that the rebar tying tool performs the tying operation when the user activates the manipulation member. In this case, the first control mode may be termed a single-action control mode for convenience sake.

In the above embodiments, the controller may be configured to shift to a second control mode when the manipulation member is activated, and may be configured to shift to the first control mode when the manipulation member is deactivated. According to such a configuration, another manipulation member for switching the control modes is not mandatory. However, in addition or as a substitute thereto, the rebar tying tool may further comprise another manipulation member for switching the control modes.

In one or more embodiments, the rebar tying tool may further comprise a detection mechanism configured to detect at least one of a plurality of rebars. In this case, while the controller executes the second control mode, the second actuation condition may be met when the detection mechanism detects at least one of the rebars. That is, the rebar tying tool may perform the tying operation when the detection mechanism detects the rebars. In this case, the second control mode may be termed a repetitive-action control mode for convenience sake.

In some of the aforementioned embodiments, the controller may further be configured to execute a third control mode. In this case, while the controller executes the third control mode, the rebar tying tool may perform the tying operation when a third actuation condition that is different from the first and second actuation conditions is met. Further, the third actuation condition may be met when the manipulation member is activated by the user and the detection mechanism detects the rebars. Alternatively, the controller may be configured to execute the third control mode as a substitute to one of the first and second control modes.

In the above embodiments, the detection mechanism may comprise a contact member configured to move, pivot, or deform by contacting at least one of the rebars. However, in addition or as a substitute thereto, the detection mechanism may comprise a noncontact sensor such as an infrared sensor.

In the above embodiments, the contact member may be pivotally supported with respect to the rebar tying tool (for example, with respect to one or more members included in a tying mechanism). According to such a configuration, a configuration of the contact member can be simplified. Further, for example, the contact member may contact the rebars by its first end, and pivot thereof at this timing may be detected at its second end. In this case, a displacement amount by the contact with the rebars can be amplified according to a principle of leverage by setting a distance between a pivot center of the contact member and one end thereof longer than a distance between the pivot center of the contact member and the other end thereof.

In the above embodiments, the tying mechanism may comprise a guide arm placed in a vicinity of the rebars and configured to guide a wire such that the wire forms a loop surrounding the rebars. In this case, the contact member may be pivotably supported by the guide arm. According to such a configuration, the detection mechanism can detect the rebars when the guide arm is placed in the vicinity of the rebars.

In one or more embodiments, a rebar tying tool may comprise a feeding mechanism configured to feed a wire, a guide arm configured to guide the wire fed from the feeding mechanism such that the wire forms a loop surrounding the rebars; and a detection mechanism configured to detect rebars placed in a vicinity of the guide arm. In this case, the detection mechanism may comprise a contact member supported by the guide arm and configured to contact at least one of the rebars. According to such a configuration, the rebars can be detected when the guide arm is placed in the vicinity of the rebars.

In the above embodiments, the contact member may be pivotably supported by the guide arm. According to such a configuration, the configuration of the contact member can be simplified. Further, depending on a structure of the contact member, the displacement amount by the contact with the rebars can be amplified according to the principle of leverage.

In the above embodiments, the guide arm may be configured to guide the wire such that the wire forms a loop along a first plane. In this case, the contact member may comprise a first contact portion located on one side relative to the first plane and a second contact portion located on the other side relative to the first plane. According to such a configuration, regardless of arrangements and shapes of the rebars, the contact member can contact at least one of the rebars.

In some of the aforementioned embodiments, the detection mechanism may comprise a magnet disposed on or in the contact member and a Hall effect sensor configured to detect a displacement of the magnet. However, not limited to the Hall effect sensor, the detection mechanism may comprise another type of sensor capable of detecting movement, pivot, or deformation of the contact member.

In one or more embodiments, a rebar tying tool may comprise at least one motor, a tying mechanism configured to be driven by the at least one motor so as to perform a tying operation of tying a plurality of rebars with a wire, a manipulation member configured to be activated and deactivated by a user, and a detection mechanism configured to detect at least one of the rebars. In this case, the tying mechanism may perform the tying operation when the user activates the manipulation member. Further, while the manipulation member is kept activated by the user, the tying mechanism may perform the tying operation when the detection mechanism detects at least one of the rebars. According to such a configuration, the user can cause the rebar tying tool to suitably perform the tying operation by activating the manipulation member. Further, by keeping the manipulation member activated, the user can cause the rebar tying tool to perform the tying operation automatically in accordance with detection of the rebars.

An embodiment of a rebar tying tool 2 will be described with reference to the drawings. The rebar tying tool 2 shown in FIG. 1 is a power tool for tying a plurality of rebars R with a wire W. In the description herein, a series of operations which the rebar tying tool 2 performs to tie the rebars R with the wire W will be termed a tying operation. Further, work for a user to tie the rebars R with the wire W by using the rebar tying tool 2 will be termed tying work.

Figure 2:
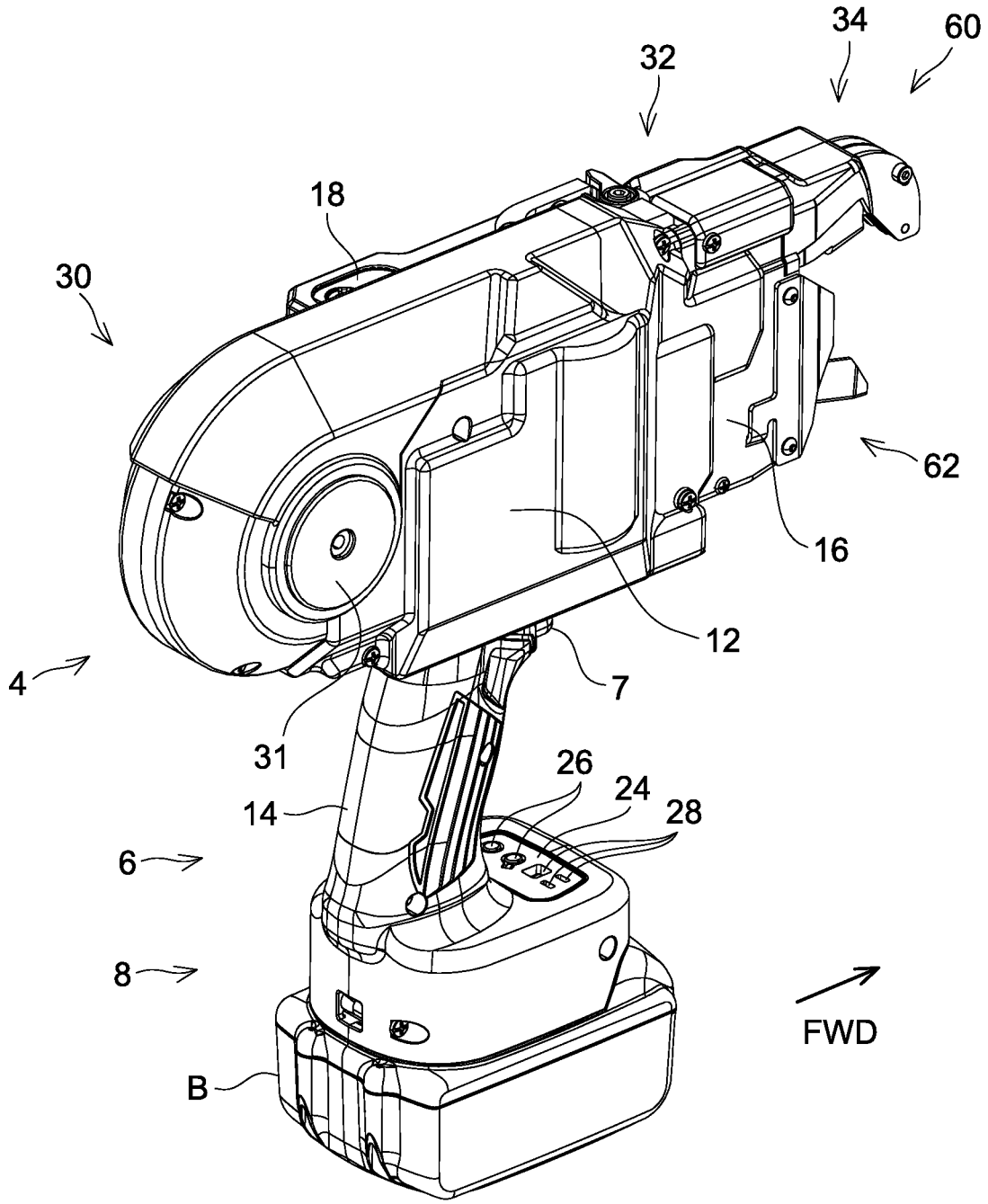
FIG. 2 is a perspective view seeing the rebar tying tool 2 from an upper-right rear side.

As shown in FIGS. 1 and 2, the rebar tying tool 2 is provided with a tying tool body 4, a grip 6 provided below the tying tool body 4, and a battery receiver 8 provided below the grip 6. A trigger 7 is provided at a front-upper part of the grip 6. A battery B is detachably attached to a lower part of the battery receiver 8. The tying tool body 4, the grip 6, and the battery receiver 8 are configured integrally by combining a right outer housing 12 and a left outer housing 14. Further, the tying tool body 4 is provided with an inner housing 16 between the right outer housing 12 and the left outer housing 14. Each of the right outer housing 12, the left outer housing 14 and the inner housing 16 constitutes at least a part of a housing of the rebar tying tool 2.

The trigger 7 is an example of a manipulation member configured to be activated and deactivated by the user. The user pulls the trigger 7 to activate it, and releases the trigger 7 to deactivate it. The rebar tying tool 2 may include a manipulation member with another configuration as a substitute to the trigger 7. A configuration and a position of the trigger 7 or the other manipulation member is not particularly limited.

The rebar tying tool 2 is provided with a first manipulation display 18 and a second manipulation display 24. The first manipulation display 18 is located on an upper surface of the tying tool body 4, although this is merely an example. The first manipulation display 18 is provided with a main switch 20 for switching power of the rebar tying tool 2 between on and off, and a main power LED 22 configured to indicate on/off states of the power of the rebar tying tool 2. The second manipulation display 24 is located on a front upper surface of the battery receiver 8, although this is merely an example. The second manipulation display 24 includes setting buttons 26 for setting a feed amount and a twisting strength of the wire W, and indicators 28 configured to indicate contents set by the setting buttons 26. The battery B, the trigger 7, the first manipulation display 18, and the second manipulation display 24 are coupled to a controller 134 to be described later. The first manipulation display 18 and the second manipulation display 24 may further include other manipulation units or indicators.

Figure 3:
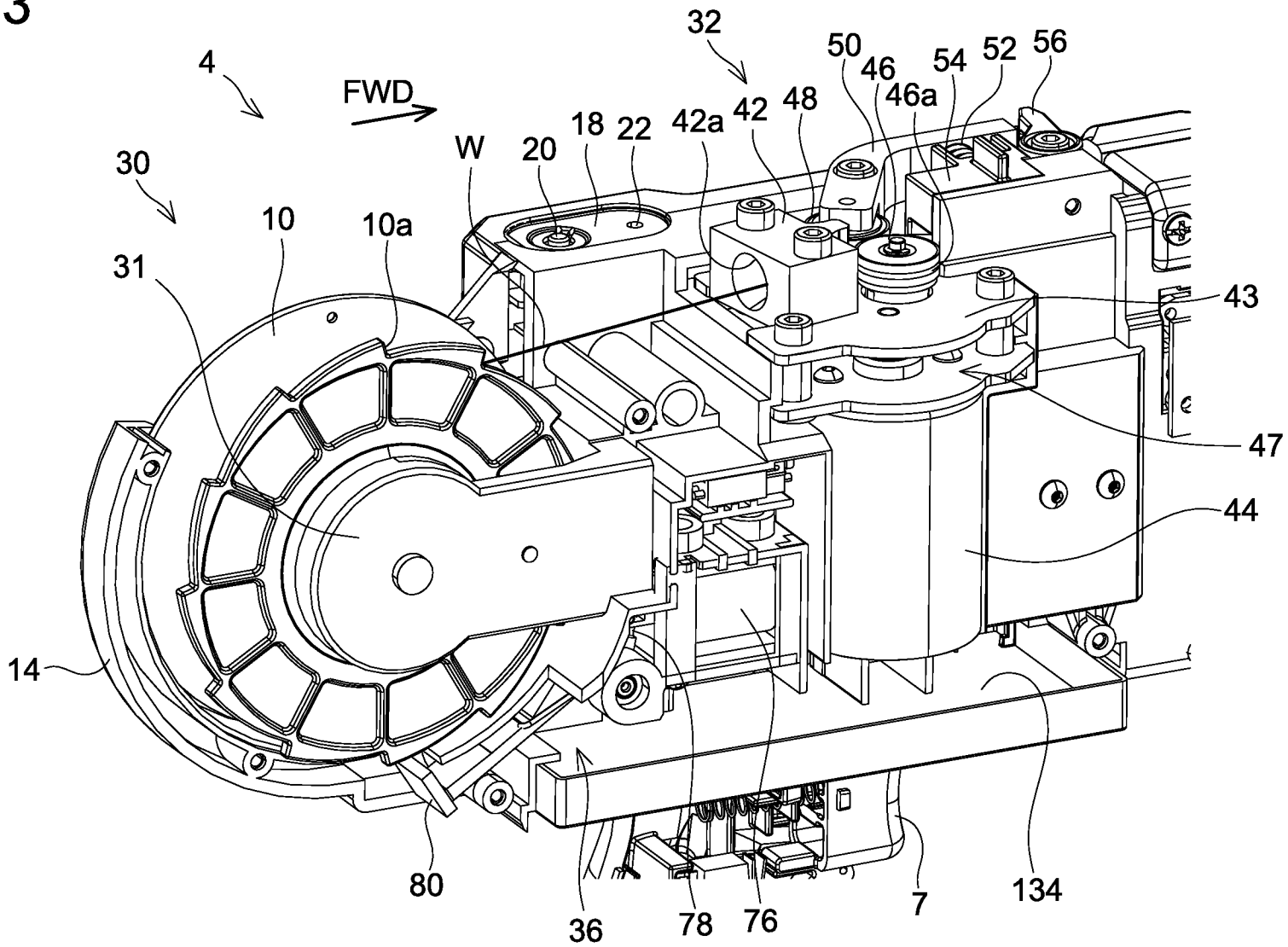
FIG. 3 is a perspective view seeing an internal structure of a tying tool body 4 of the rebar tying tool 2 from the upper-right rear side.
Figure 4:
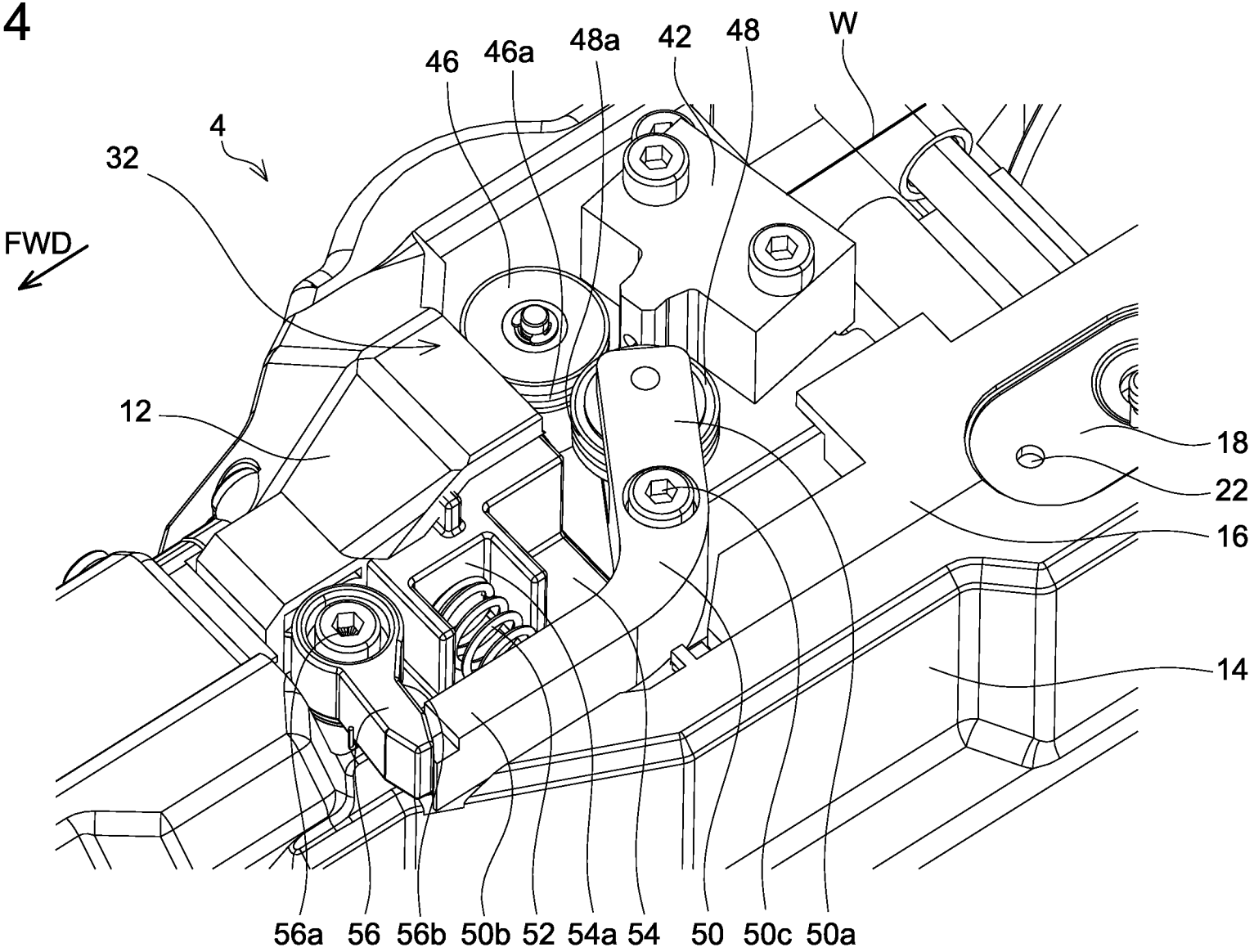
FIG. 4 is a perspective view seeing a wire feeding mechanism 32 of the rebar tying tool 2 from an upper-left front side.
Figure 5:
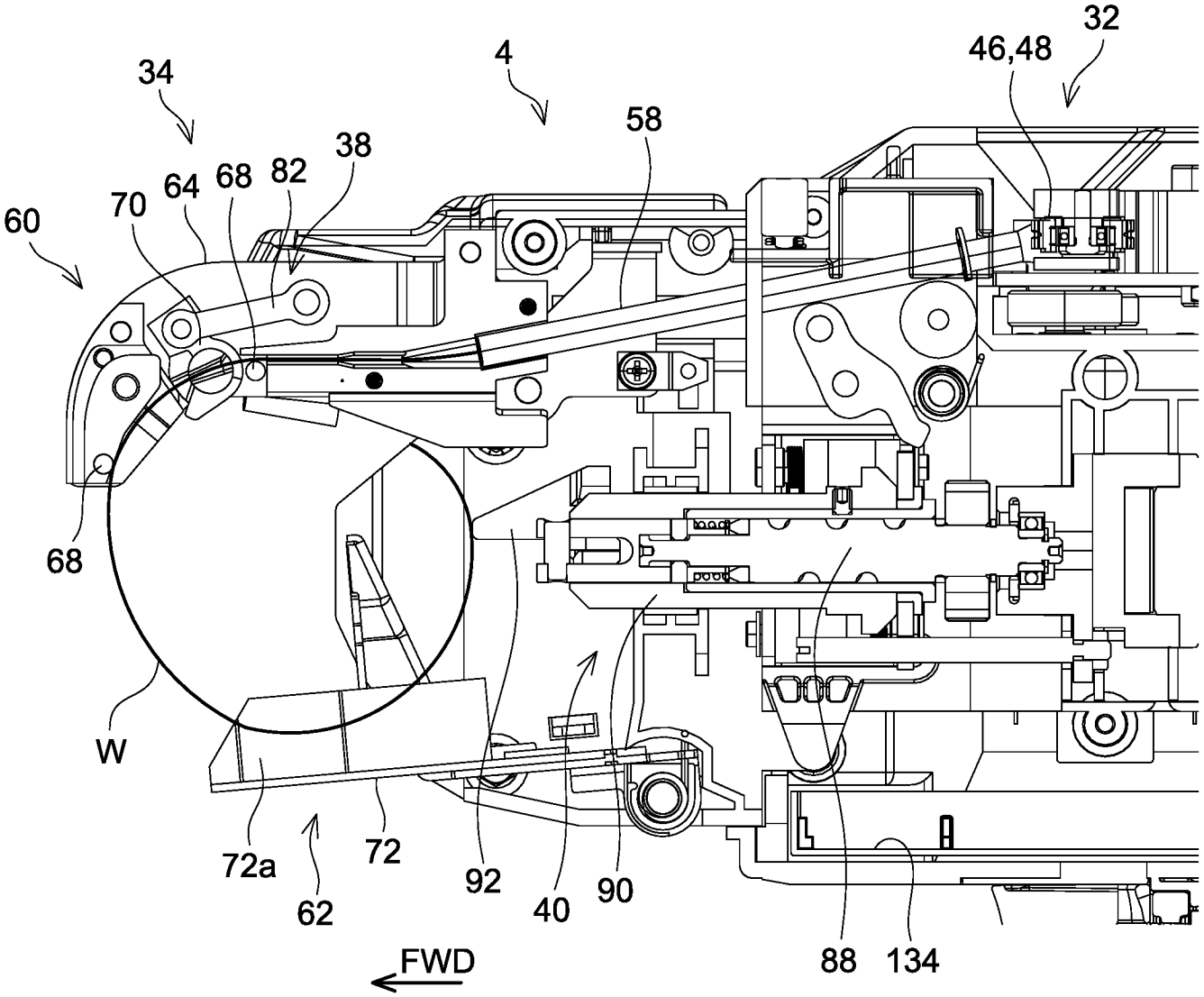
FIG. 5 is a cross-sectional view seeing the internal structure of the tying tool body 4 of the rebar tying tool 2 from a left side.
Figure 6:
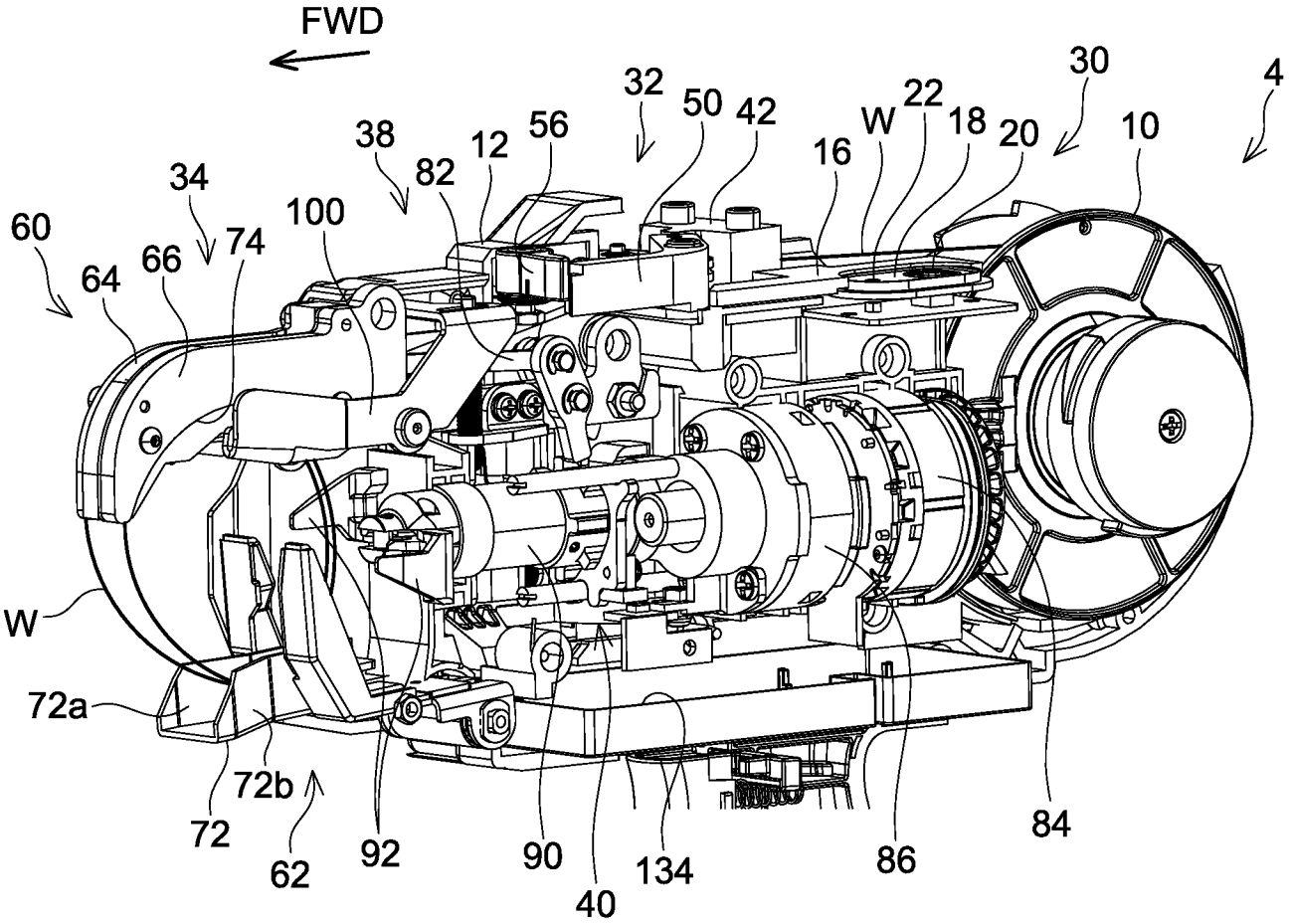
FIG. 6 is a perspective view seeing the internal structure of the tying tool body 4 of the rebar tying tool 2 from a left front side.

As shown in FIGS. 3 to 6, the rebar tying tool 2 primarily includes a reel retaining mechanism 30 (see FIG. 3), a wire feeding mechanism 32 (see FIGS. 3 and 4), a wire guiding mechanism 34 (see FIGS. 5 and 6), a brake mechanism 36 (see FIG. 3), a wire cutting mechanism 38 (see FIG. 5), and a wire twisting mechanism 40 (see FIGS. 5 and 6). These mechanisms constitute a tying mechanism configured to perform the tying operation of tying the rebars R with the wire W. However, a specific configuration of the tying mechanism is not limited to this combination of mechanisms, and may suitably be modified. Further, the rebar tying tool 2 is provided with the controller 134 (see FIGS. 3, 5, and 6). For clearer illustration, FIG. 3 omits depictions of the right outer housing 12 and a cover 116 (details of which will be described later), FIG. 4 omits the depiction of the cover 116, and FIG. 6 omits depictions of the left outer housing 14 and the cover 116. Further, FIGS. 3 to 6 also omit a depiction of wiring inside the rebar tying tool 2. The controller 134 is disposed at a central lower part of the tying tool body 4 by traversing over the inner housing 16. A part of the controller 134 is disposed on one side (right outer housing 12 side) as seen from the inner housing 16, and another part of the controller 134 is disposed on the other side (left outer housing 14 side) as seen from the inner housing 16. The controller 134 is configured to control the tying mechanism of the rebar tying tool 2.

The reel retaining mechanism 30 detachably receives a reel 10 onto which the wire W is wound. A specific configuration of the reel retaining mechanism 30 is not particularly limited. As shown in FIG. 3, the reel retaining mechanism 30 of the present embodiment includes a pair of reel holders 31 configured to rotatably support the reel 10.

The wire feeding mechanism 32 feeds the wire W to the wire guiding mechanism 34. A specific configuration of the wire guiding mechanism 34 is not particularly limited. As shown in FIGS. 3 and 4, the wire feeding mechanism 32 of the present embodiment feeds the wire W supplied from the reel 10 retained by the reel retaining mechanism 30 to the wire guiding mechanism 34 (see FIGS. 5 and 6) in front of the tying tool body 4. The wire feeding mechanism 32 is provided with a guide block 42, a base member 43, a feed motor 44, a main gear 46, a reducer mechanism 47, a driven gear 48, a release lever 50, a compression spring 52, a lever holder 54, and a fixation lever 56. The guide block 42 includes a cone-trapezoidal through hole 42*a* with a wide rear end and a narrow front end. The guide block 42 is fixed to the base member 43. The main gear 46 and the driven gear 48 are placed forward than the guide block 42. The main gear 46 is coupled to the feed motor 44 via the reducer mechanism 47, and is configured to rotate by the feed motor 44 being driven. The feed motor 44 is coupled to the controller 134 by a line that is not shown. The controller 134 is configured to control an operation of the feed motor 44. A side surface of the main gear 46 is provided with a V-shaped groove 46*a* extending in a circumferential direction of the main gear 46 at a heightwise center thereof As shown in FIG. 4, the driven gear 48 is rotatably supported by a gear arm 50*a* of the release lever 50. A side surface of the driven gear 48 is provided with a V-shaped groove 48*a* extending in a circumferential direction of the driven gear 48 at a heightwise center thereof.

The release lever 50 is a substantially L-shaped member including the gear arm 50*a* and an operation arm 50*b*. The release lever 50 is pivotably supported by the base member 43 via a pivot shaft 50*c*. The operation arm 50*b* of the release lever 50 is coupled to a spring receiver 54*a* of the lever holder 54 via the compression spring 52. The lever holder 54 is fixed by being held between the inner housing 16 and the left outer housing 14. The compression spring 52 biases the operation arm 50*b* in a direction separating away from the spring receiver 54*a*. Under a normal state, torque acts on the release lever 50 in a direction bringing the driven gear 48 closer to the main gear 46 by biasing force of the compression spring 52, by which the driven gear 48 is pressed against the main gear 46. Due to this, teeth on the side surface of the driven gear 48 and teeth on the side surface of the main gear 46 mesh, and the wire W is held between the V-shaped groove 46*a* of the main gear 46 and the V-shaped groove 48*a* of the driven gear 48. When the feed motor 44 rotates the main gear 46 in this state, the driven gear 48 rotates in a reverse direction, and the wire W is fed out from the reel 10 to the wire guiding mechanism 34.

The fixation lever 56 is pivotally supported by the lever holder 54 via a pivot shaft 56*a*. The fixation lever 56 is biased by a torsion spring, which is not shown, in a direction abutting the operation arm 50*b* of the release lever 50. The fixation lever 56 is provided with a recess 56*b* configured to engage with a tip end of the operation arm 50*b* of the release lever 50.

When the user of the rebar tying tool 2 pushes in the operation arm 50*b* against the biasing force of the compression spring 52, the release lever 50 pivots about the pivot shaft 50*c* and the driven gear 48 separates from the main gear 46. At this occasion, the fixation lever 56 pivots about the pivot shaft 56*a* and the tip end of the operation arm 50*b* is engaged with the recess 56*b*, by which the operation arm 50*b* is retained in a state of being pushed in. When the wire W extending from the reel 10 retained by the reel retaining mechanism 30 is to be set in the wire feeding mechanism 32, the user pushes in the operation arm 50*b* to separate the driven gear 48 from the main gear 46, and in this state places a distal end of the wire W drawn out from the reel 10 between the main gear 46 and the driven gear 48 through the through hole 42*a* of the guide block 42. Then, when the user moves the fixation lever 56 in a direction separating away from the operation arm 50*b*, the release lever 50 pivots about the pivot shaft 50*c*, by which the driven gear 48 engages with the main gear 46 and the wire W is held between the V-shaped groove 46*a* of the main gear 46 and the V-shaped groove 48*a* of the driven gear 48.

The wire guiding mechanism 34 is configured to guide the wire W such that the wire W fed out by the wire feeding mechanism 32 forms a loop surrounding the plurality of rebars R. A specific configuration of the wire guiding mechanism 34 is not particularly limited. As shown in FIGS. 5 and 6, the wire guiding mechanism 34 of the present embodiment includes a guide pipe 58, an upper guide arm 60, and a lower guide arm 62. A rear-side end of the guide pipe 58 is open toward a position between the main gear 46 and the driven gear 48. The wire W fed out from the wire feeding mechanism 32 is fed into the guide pipe 58. A front-side end of the guide pipe 58 is open toward inside the upper guide arm 60. The upper guide arm 60 includes a first guide passage 64 for guiding the wire W fed from the guide pipe 58 and a second guide passage 66 (see FIG. 6) for guiding the wire W fed from the lower guide arm 62.

As shown in FIG. 5, the first guide passage 64 is provided with a plurality of guide pins 68 configured to guide the wire W to give the wire W a downward curl, and a cutter 70 constituting a part of the wire cutting mechanism 38 to be described later. The wire W fed from the guide pipe 58 is guided by the guide pins 68 in the first guide passage 64, passes through the cutter 70, and is fed from a front end of the upper guide arm 60 toward the lower guide arm 62.

As shown in FIG. 6, the lower guide arm 62 is provided with a third guide passage 72. The third guide passage 72 is provided with a right guide wall 72*a* and a left guide wall 72*b* that are configured to guide the wire W fed from the front end of the upper guide arm 60. The wire W guided by the lower guide arm 62 is fed toward a rear end of the second guide passage 66 of the upper guide arm 60.

The second guide passage 66 of the upper guide arm 60 is provided with an upper guide wall 74 configured to guide the wire W fed from the lower guide arm 62 and feed the same toward the lower guide arm 62 from the front end of the upper guide arm 60.

The wire W fed from the wire feeding mechanism 32 forms one or more loops surrounding the plurality of rebars R by the upper guide arm 60 and the lower guide arm 62. The loop(s) of the wire W are formed between the upper guide arm 60 and the lower guide arm 62. When having fed out the wire W by a feed amount of the wire W set by the user, the wire feeding mechanism 32 stops the feed motor 44 to stop the feeding of the wire W.

When the wire feeding mechanism 32 stops feeding the wire W, the brake mechanism 36 shown in FIG. 3 prohibits rotation of the reel 10. The brake mechanism 36 is provided with a solenoid 76, a link 78, and a brake arm 80. The solenoid 76 of the brake mechanism 36 is coupled to the controller 134 by a line that is not shown. The controller 134 is configured to control an operation of the brake mechanism 36. The reel 10 is provided with engaging portions 10*a* to which the brake arm 80 engages and that are arranged at predetermined angle intervals in a radial direction. In a state where the solenoid 76 is not electrically conducted, the brake arm 80 is separated away from the engaging portions 10*a* of the reel 10. In a state where the solenoid 76 is electrically conducted, the brake arm 80 engages with one of the engaging portions 10*a* of the reel 10 by the link 78. When the wire feeding mechanism 32 feeds out the wire W, the brake mechanism 36 maintains the brake arm 80 separated away from the engaging portions 10*a* of the reel 10 by not electrically conducting the solenoid 76. Due to this, the reel 10 can rotate freely, and the wire feeding mechanism 32 can draw out the wire W from the reel 10. Further, when the wire feeding mechanism 32 stops feeding the wire W, the brake mechanism 36 electrically conducts the solenoid 76 to bring the brake arm 80 to engage with one of the engaging portions 10*a* of the reel 10. Due to this, the rotation of the reel 10 is prohibited. Due to this, the reel 10 can be prevented from continuing to rotate by inertia even after the wire feeding mechanism 32 has stopped feeding the wire W, by which the wire W can be prevented from becoming loose between the reel 10 and the wire feeding mechanism 32.

The wire cutting mechanism 38 shown in FIG. 5 is configured to cut the wire W after the wire W has formed the loop(s) surrounding the rebars R. The wire cutting mechanism 38 is provided with the cutter 70 and a link 82. The link 82 cooperates with the wire twisting mechanism 40 to be described later to rotate the cutter 70. The wire W passing through inside the cutter 70 is cut by rotation of the cutter 70.

The wire twisting mechanism 40 ties the rebars R with the wire W by twisting the loop-shaped wire W surrounding the rebars R. A specific configuration of the wire twisting mechanism 40 is not particularly limited. As shown in FIG. 6, the wire twisting mechanism 40 of the present embodiment is provided with a twist motor 84, a reducer mechanism 86, a screw shaft 88 (see FIG. 5), a sleeve 90, and a pair of hooks 92. The pair of hooks 92 is an example of a wire engaging portion configured to engage with and disengage from the loop-shaped wire W, and is configured to be driven to rotate by the twist motor 84.

Rotation of the twist motor 84 is transmitted to the screw shaft 88 via the reducer mechanism 86. The twist motor 84 is capable of rotating in a forward direction and a reverse direction, according to which the screw shaft 88 is also capable of rotating in the forward direction and the reverse direction. The twist motor 84 is coupled to the controller 134 via a line that is not shown. The controller 134 is configured to control an operation of the twist motor 84. The sleeve 90 is placed to cover a periphery of the screw shaft 88. In a state where rotation of the sleeve 90 is prohibited, the sleeve 90 moves forward when the screw shaft 88 rotates in the forward direction, and the sleeve 90 moves rearward when the screw shaft 88 rotates in the reverse direction. Further, in a state where the rotation of the sleeve 90 is allowed, the sleeve 90 rotates together with the screw shaft 88 when the screw shaft 88 rotates. Further, when the sleeve 90 moves forward from its initial position to a predetermined position, the link 82 of the wire cutting mechanism 38 rotates the cutter 70. The pair of hooks 92 is provided at a front end of the sleeve 90, and opens and closes in accordance with a position of the sleeve 90 in a front-rear direction. The pair of hooks 92 closes to hold the wire W when the sleeve 90 moves forward. To the contrary, the pair of hooks 92 opens to release the wire W when the sleeve 90 moves rearward.

When the twist motor 84 rotates, the screw shaft 88 rotates. Since the rotation of the sleeve 90 is prohibited, the sleeve 90 and the pair of hooks 92 move forward. Due to this, the pair of hooks 92 closes to engage with the loop-shaped wire W, and the rotation of the sleeve 90 is allowed. When the rotation of the sleeve 90 is allowed, the sleeve 90 and the pair of hooks 92 rotate by the rotation of the screw shaft 88. Due to this, the wire W is twisted, and the rebars R are thereby tied. The user can set a twisting strength of the wire W in advance. When the wire twisting mechanism 40 twists the wire W to the set twisting strength, it rotates the twist motor 84 in the reverse direction. At this occasion, the rotation of the sleeve 90 is prohibited, and as such, the sleeve 90 moves rearward and the pair of hooks 92 also moves rearward while opening by the rotation of the screw shaft 88, by which the wire W is released. After this, the pair of hooks 92 moves rearward to its initial position and the rotation of the sleeve 90 is allowed, and the pair of hooks 92 return to have its initial angle.

Figure 7:
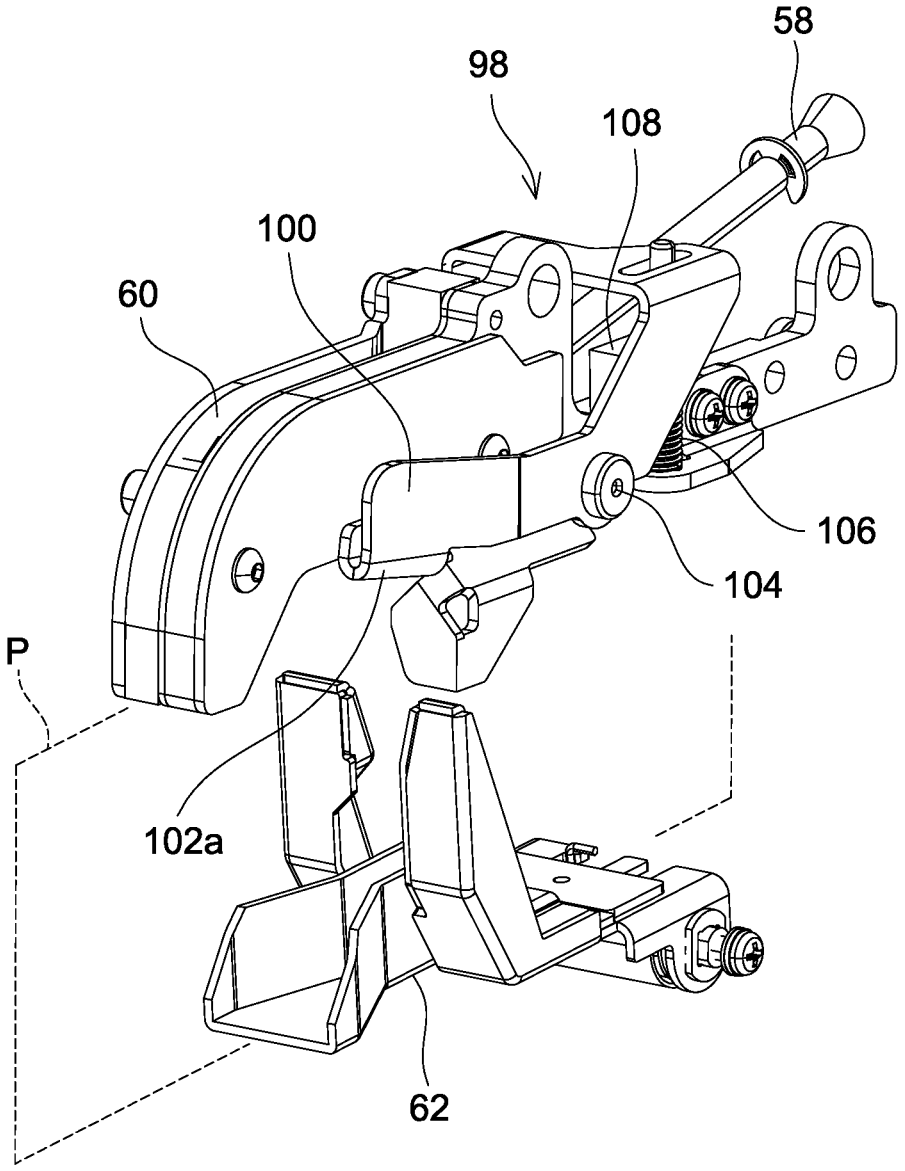
FIG. 7 shows a rebar detection mechanism 98.
Figure 8:
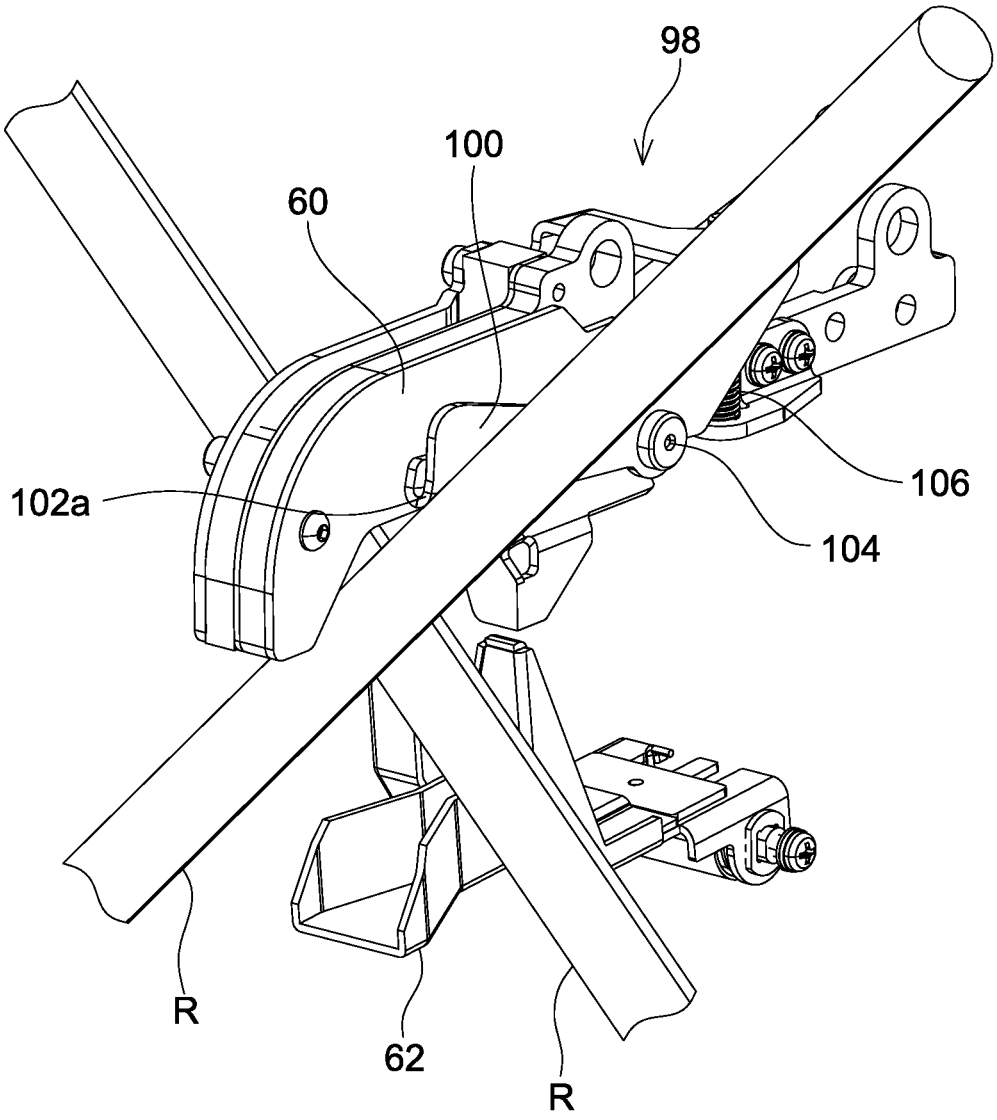
FIG. 8 shows the rebar detection mechanism 98 with rebars R.
Figure 9:
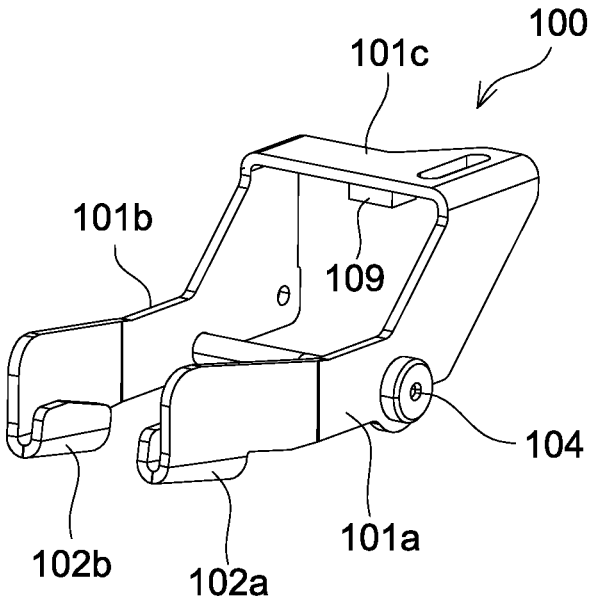
FIG. 9 shows a contact plate 100.

As shown in FIGS. 7, 8, and 9, the rebar tying tool 2 is provided with a rebar detection mechanism 98. The rebar detection mechanism 98 is configured to detect at least one of the plurality of rebars R that is close to or in contact with the rebar tying tool 2. Although this is merely an example, the rebar detection mechanism 98 of the present embodiment is configured to detect the rebar(s) R close to the upper guide arm 60. The rebar detection mechanism 98 includes a contact plate 100 and a contact sensor 108. The contact plate 100 is attached to the upper guide arm 60 via a shaft 104, and is supported so as to be pivotable with respect to the upper guide arm 60. The contact plate 100 is biased toward its initial position by an elastic member 106. When the contact plate 100 comes into contact with at least one of the plurality of rebars R, it pivots from the initial position with respect to the upper guide arm 60. When the contact plate 100 moves from the initial position, the contact sensor 108 thereby operates. The contact sensor 108 is coupled to the controller 134, and a predetermined signal is inputted to the controller 134 when the contact sensor 108 operates. Although not particularly limited, the contact sensor 108 of the present embodiment includes a Hall effect sensor and is configured to selectively output a binary signal according to its distance from a magnet 109 (see FIG. 9) provided in the contact member. Here, positions of the contact sensor 108 including the Hall effect sensor and the magnet 109 are not particularly limited. The contact sensor 108 may be provided inside, outside, above, below, to a right side relative to, or to a left side relative to the contact plate 100. Further, a position where the magnet 109 is provided in the contact plate 100 is not particularly limited. Although this is merely an example, the magnet 109 may be fixed to the contact plate 100 via a resin bracket. In another embodiment, the contact sensor 108 may be a switch configured to mechanically operate in accordance with pivot of the contact plate 100.

The contact plate 100 includes a first contact portion 102*a* and a second contact portion 102*b* (see FIG. 9). The first contact portion 102*a* is located on one side relative to the upper guide arm 60 and the second contact portion 102*b* is located on the other side relative to the upper guide arm 60. More specifically, the first contact portion 102*a* is located on one side relative to a first plane P shown in FIG. 7, and the second contact portion 102*b* is located on the other side relative to the first plane P. Here, the first plane P is a plane along which the upper guide arm 60 and the lower guide arm 62 guide the wire W. In other words, the upper guide arm 60 and the lower guide arm 62 guide the wire W such that the wire W forms the loop(s) along the first plane P. Due to the contact plate 100 being provided with the first contact portion 102*a* and the second contact portion 102*b*, the contact plate 100 can contact at least one of the rebars R regardless of arrangements and shapes of the rebars R. The first contact portion 102*a* and the second contact portion 102*b* are located at an end of the contact plate 100 located on one side relative to the shaft 104, and the contact sensor 108 is configured to detect a displacement of an end of the contact plate 100 located on the other side relative to the shaft 104 by using the magnet 109.

The contact plate 100 of the present embodiment includes a first lever 101*a* located on the one side relative to the upper guide arm 60, a second lever 101*b* located on the other side relative to the upper guide arm 60, and a connecting portion 101*c* connecting the first lever 101*a* and the second lever 101*b* to each other. The first lever 101*a* includes the first contact portion 102*a* at one end thereof and is connected to the connecting portion 101*c* at the other end thereof. Similarly, the second lever 101*b* includes the second contact portion 102*b* at one end thereof and is connected to the connecting portion 101*c* at the other end thereof. The magnet 109 is provided on the connecting portion 101. The aforementioned structure is an example, and the structure of the contact plate 100 is not limited thereto. The rebar detection mechanism 98 may include a contact member with a different configuration as a substitute to or in addition to the contact plate 100. In this case, the contact member may be configured to move, pivot, or deform by coming into contact with at least one of the rebars R. Further, the contact sensor 108 may be configured to detect the movement, pivot, or deformation of the contact member. The rebar detection mechanism 98 may include a noncontact sensor capable of detecting the rebars R, such as an infrared sensor, as a substitute to or in addition to the contact plate 100 and the other contact member.

As above, the rebar tying tool 2 of the present embodiment is provided with the tying mechanism configured to perform the tying operation of tying the plurality of rebars R with the wire W. The tying mechanism of the present embodiment is provided with the reel retaining mechanism 30, the wire feeding mechanism 32, the wire guiding mechanism 34, the brake mechanism 36, the wire cutting mechanism 38, and the wire twisting mechanism 40 as aforementioned, however, it is not limited thereto. For example, the tying mechanism may be provided only with the wire twisting mechanism 40. In this case, the loop-shaped wire W surrounding the plurality of rebars R may be prepared by another device or by the user.

Operations of the rebar tying tool 2, especially operation of the tying mechanism, are controlled by the controller 134. The controller 134 is electrically coupled to the trigger 7 and the rebar detection mechanism 98, and is configured to control the operation of the tying mechanism primarily based on a manipulation performed on the trigger 7 and a detection result of the rebar detection mechanism 98. The controller 134 of the present embodiment is configured capable of selectively executing a plurality of control modes including a first control mode and a second control mode. While the controller 134 executes the first control mode, the tying mechanism performs the tying operation when a first actuation condition is met. While the controller 134 executes the second control mode, the tying mechanism performs the tying operation when a second actuation condition is met. The second actuation condition is different from the first actuation condition.

As shown in FIG. 10, an actuation condition for the first control mode (that is, the first actuation condition) is an activation of the trigger 7 by the user. That is, while the controller 134 executes the first control mode, the rebar tying tool 2 starts the tying operation when the user activates the trigger 7. Such a control mode may be termed a single-action control mode. In the first control mode, the detection result of the rebar detection mechanism 98 is disregarded. According to the first control mode, the user can freely decide a timing for the rebar tying tool 2 to start the tying operation by actuating the trigger 7. On the other hand, an actuation condition for the second control mode (that is, the second actuation condition) is detection of the rebars R by the rebar detection mechanism 98. That is, while the controller 134 executes the second control mode, the rebar tying tool 2 starts the tying operation when the rebar detection mechanism 98 detects the rebars R. Such a control mode may be termed a repetitive-action control mode. According to the second control mode, the tying operation is automatically started at a timing when the rebar tying tool 2 is positioned correctly with respect to the rebars R. Thus, the user can perform the tying work many times in a relatively short time period.

Figure 11:
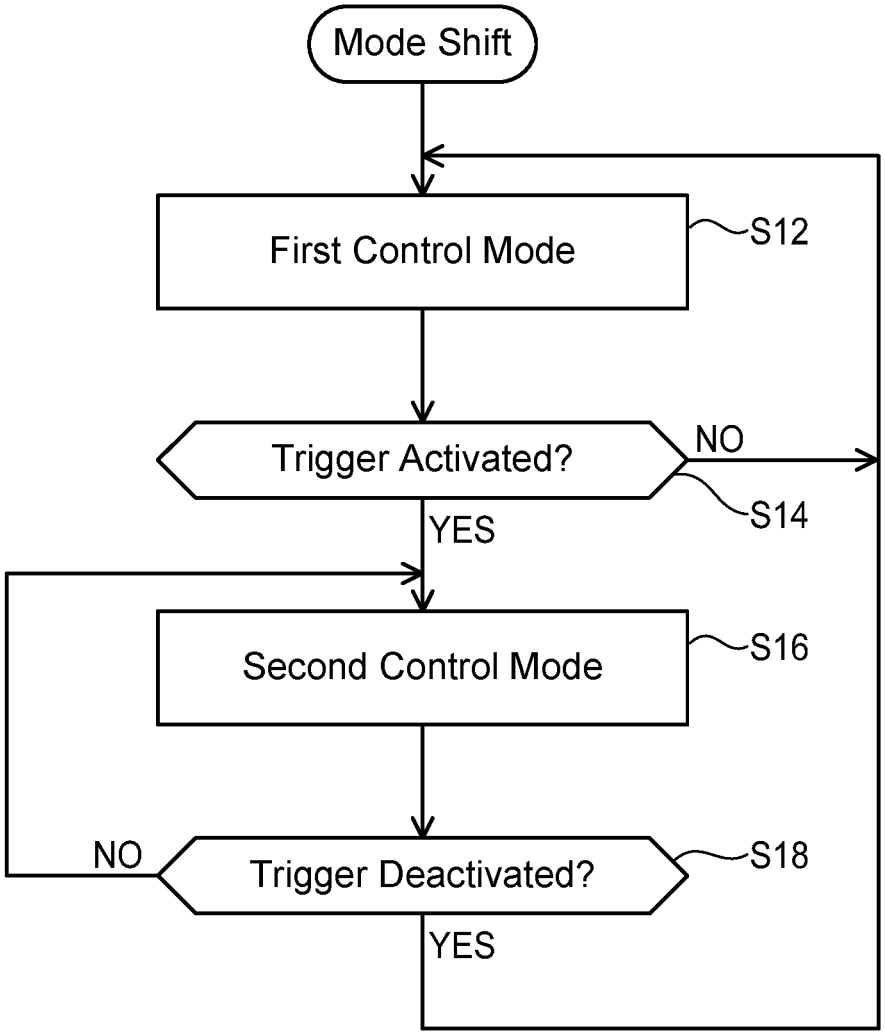
FIG. 11 is a flowchart showing an example of a process for a controller 134 to switch control modes between first and second control modes.

The controller 134 of the present embodiment switches the control modes according to activation and deactivation performed on the trigger 7. Although this is merely an example, as shown in FIG. 11, when the trigger 7 is activated (S14) the controller 134 shifts from the first control mode to the second control mode (S16), and when the trigger 7 is deactivated (S18) the controller 134 shifts from the second control mode to the first control mode (S12). That is, the controller 134 executes the first control mode during when the trigger 7 is deactivated, and the controller 134 executes the second control mode during when the trigger 7 is activated. Here, the shift from the first control mode to the second control mode may take place immediately after the trigger 7 is activated, or may take place after a predetermined delay time since the trigger 7 was activated. Alternatively, the shift from the first control mode to the second control mode may take place after completion of the tying operation that is performed by the activation on the trigger 7.

According to the aforementioned configuration of the controller 134, the controller 134 executes the first control mode until the user activates the trigger 7. When the user activates the trigger 7, the actuation condition for the first control mode (that is, the first actuation condition) is met, so the rebar tying tool 2 starts the tying operation. At the same time, the controller 134 shifts from the first control mode to the second control mode. If the user keeps the trigger 7 activated, the controller 134 maintains the second control mode. Thus, while the user keeps the trigger 7 activated, the rebar tying tool 2 starts the tying operation when the rebar detection mechanism 98 detects the rebars R. When the user deactivates the trigger 7, the controller 134 shifts to the first control mode. In this state, the rebar tying tool 2 does not start the tying operation even when the rebar detection mechanism 98 detects the rebars R.

Figure 12:
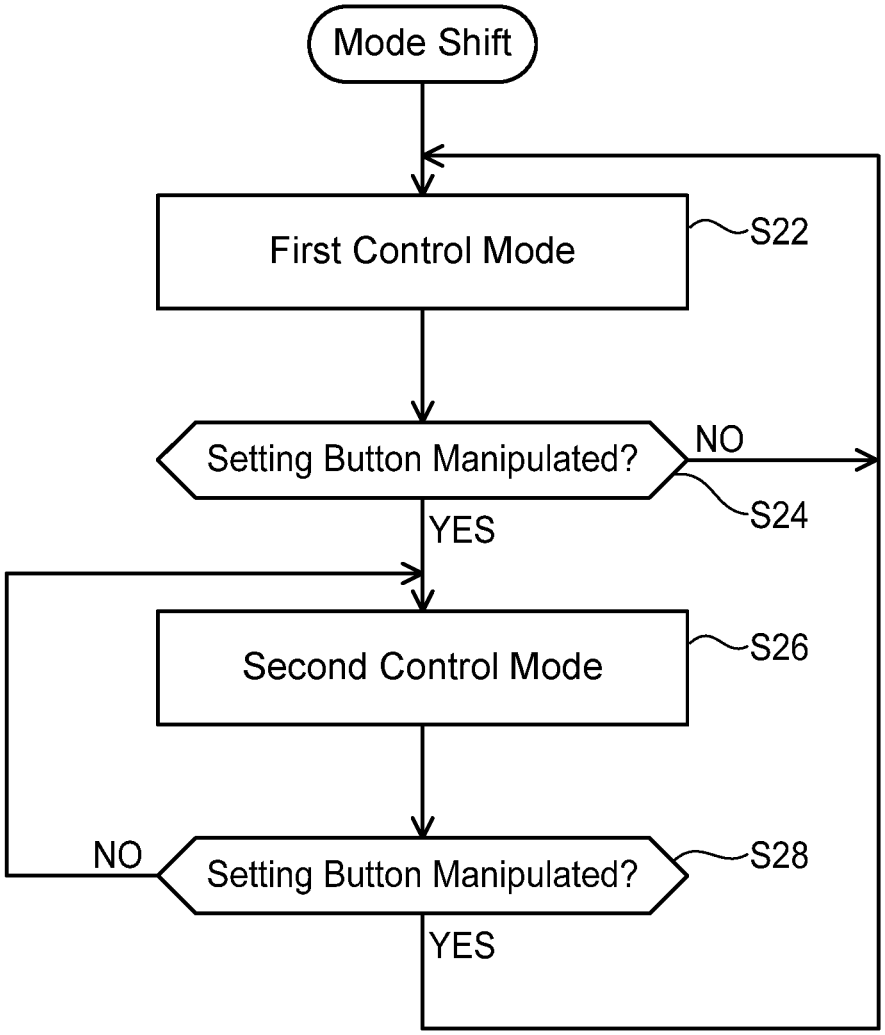
FIG. 12 is a flowchart showing an example of the process for the controller 134 to switch control modes between the first and second control modes.

In one or more embodiments, the switching between the control modes may be executed by the setting buttons 26. In this case, although this is merely an example, as shown in FIG. 12, when the setting buttons 26 are manipulated (S24) the controller 134 may shift from the first control mode to the second control mode (S26), and when the setting buttons 26 are manipulated again (S28) the controller 134 may shift from the second control mode to the first control mode (S22). Not limited to the setting buttons 26, the switching between the control modes may be executed by the first manipulation display 18, the second manipulation display 24, or another manipulation unit.

In one or more embodiments, the controller 134 may be configured capable of selectively executing a third control mode in addition to the first and second control modes. In this case, while the controller 134 executes the third control mode, the tying mechanism performs the tying operation when a third actuation condition is met. The third actuation condition is different from the first and second actuation conditions. As shown in FIG. 13, an actuation condition for the third control mode (that is, the third actuation condition) is the activation of the trigger 7 by the user and the detection of the rebars R by the rebar detection mechanism 98. That is, while the controller 134 executes the third control mode, the rebar tying tool 2 starts the tying operation when the user activates the trigger 7 and the rebar detection mechanism 98 detects the rebars R. Further, although this is a supplemental feature, in the third control mode, the controller 134 prohibits a subsequent tying operation after the rebar tying tool 2 had performed the tying operation once, until the user deactivates the trigger 7 and the rebar detection mechanism 98 no longer detects the rebars R. According to the third control mode, an unintended operation of the rebar tying tool is prevented as compared to the first and second control modes.

Figure 14:
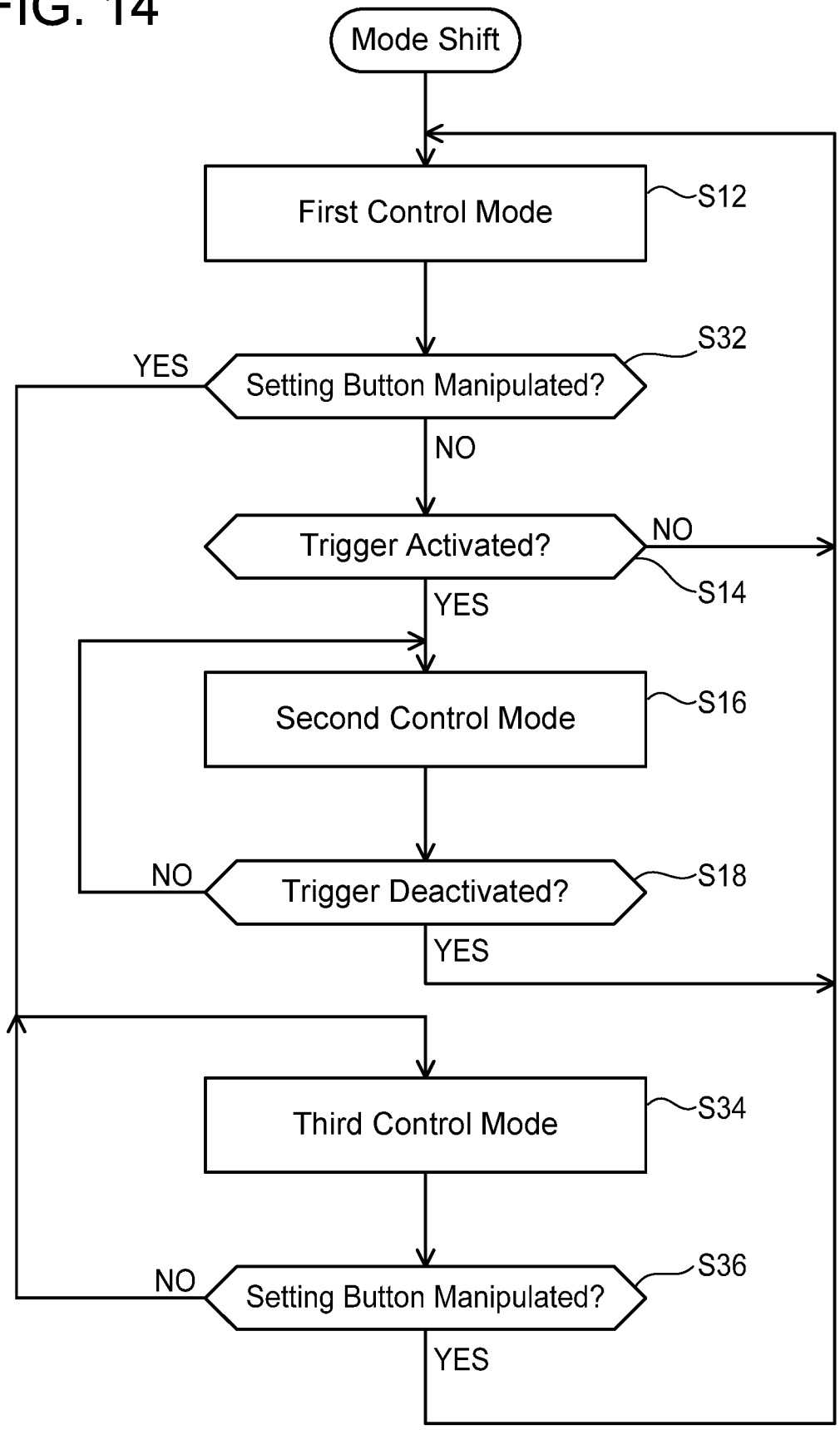
FIG. 14 is a flowchart showing an example of a process for the controller 134 to switch control modes among first, second, and third control modes.

Switching among the first, second, and third control modes may be executed by using the trigger 7, or may be executed by the setting buttons 26 or another manipulation unit. An example is shown in FIG. 14. In this example, when the trigger 7 is activated (S14) the controller 134 shifts from the first control mode to the second control mode (S16), and when the trigger 7 is deactivated (S18) the controller 134 shifts from the second control mode to the first control mode (S12). This is similar to the flow shown in FIG. 11. In addition to this, when the setting buttons 26 are manipulated while the first control mode is executed (S32), the controller 134 shifts from the first control mode to the third control mode (S34). Then, when the setting buttons 26 are manipulated again while the third control mode is executed (S36), the controller 134 returns from the third control mode to the first control mode (S12).

Figure 15:
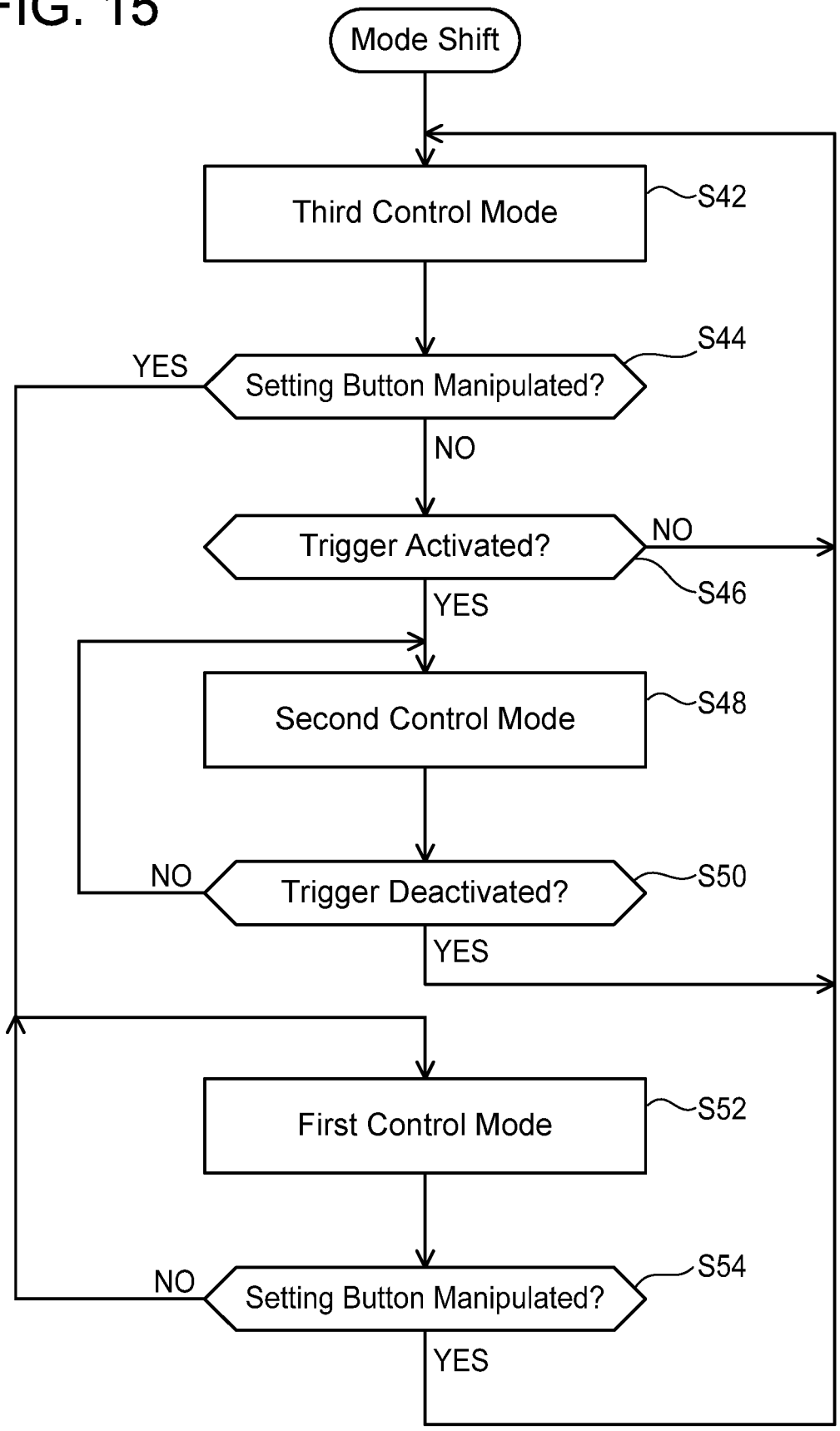
FIG. 15 is a flowchart showing an example of the process for the controller 134 to switch control modes among the first, second, and third control modes.

FIG. 15 shows another example. In this example, when the trigger 7 is activated (S46) the controller 134 shifts from the third control mode to the second control mode (S48), and when the trigger 7 is deactivated (S50) the controller 134 shifts from the second control mode to the third control mode (S42). In addition to this, when the setting buttons 26 are manipulated while the third control mode is executed (S44), the controller 134 shifts from the third control mode to the first control mode. Then, when the setting buttons 26 are manipulated again while the first control mode is executed, the controller 134 returns from the first control mode to the third control mode.

Figure 16:
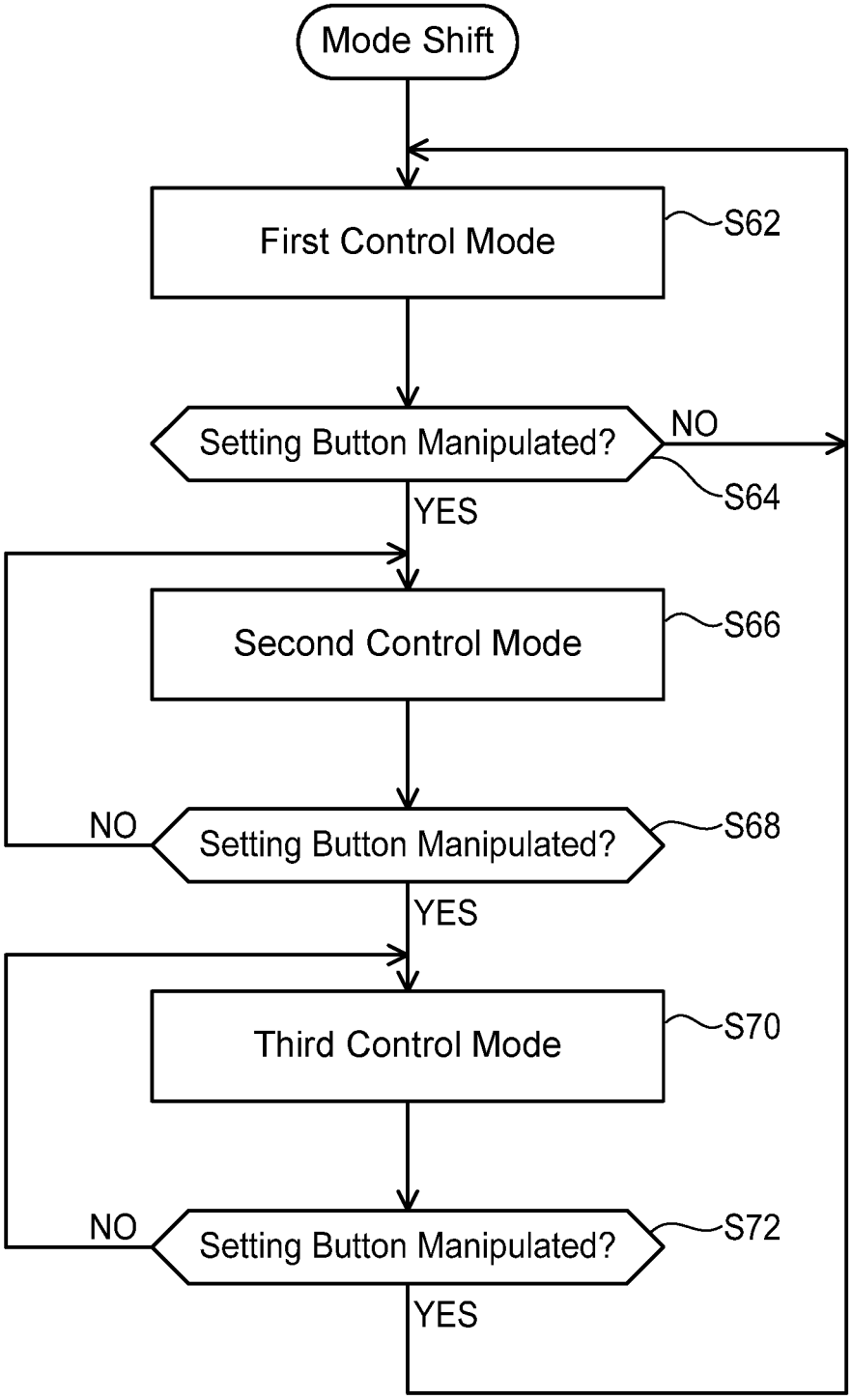
FIG. 16 is a flowchart showing an example of the process for the controller 134 to switch control modes among the first, second, and third control modes.

FIG. 16 shows another example. In this example, when the setting buttons 26 are manipulated (S64), the controller 134 shifts from the first control mode to the second control mode (S66). When the setting buttons 26 are manipulated again (S68), the controller 134 shifts from the second control mode to the third control mode (S70). Then, when the setting buttons 26 are manipulated again (S72), the controller 134 shifts from the third control mode to the first control mode (S62). Not limited to the setting buttons 26, the switching among the control modes may be executed by the first manipulation display 18, the second manipulation display 24, or another manipulation unit.

Figure 17:
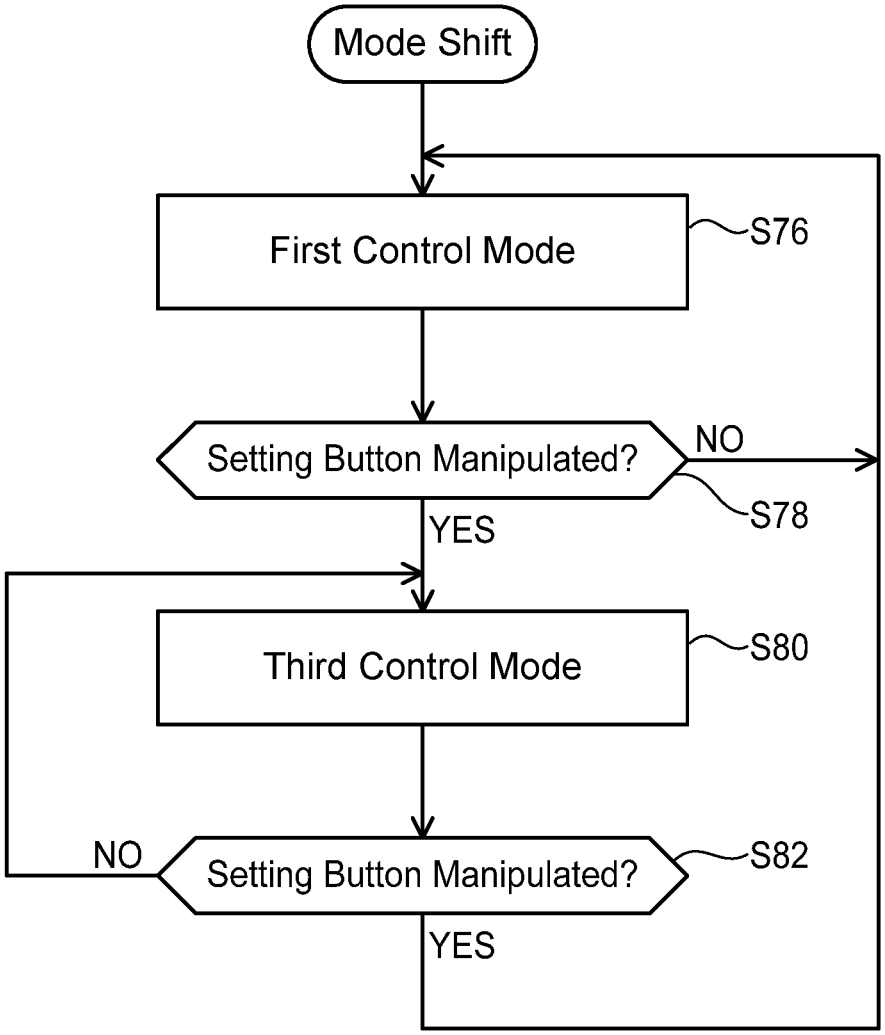
FIG. 17 is a flowchart showing an example of a process for the controller 134 to switch control modes between the first and third control modes.

In one or more embodiments, the controller 134 may be configured capable of executing the third control mode as substitute to one of the first and second control modes. FIG. 17 shows an example of a process in which the controller 134 switches the control modes in an embodiment where the controller 134 is configured capable of selectively executing the first control mode and the third control mode. In this example, when the setting buttons 26 are manipulated (S78) the controller 134 shifts from the first control mode to the third control mode (S80), and when the setting buttons 26 are manipulated again (S82) the controller 134 shifts from the third control mode to the first control mode (S76). Not limited to the setting buttons 26, the switching between the control modes may be executed by the first manipulation display 18, the second manipulation display 24, or another manipulation unit.

Figure 18:
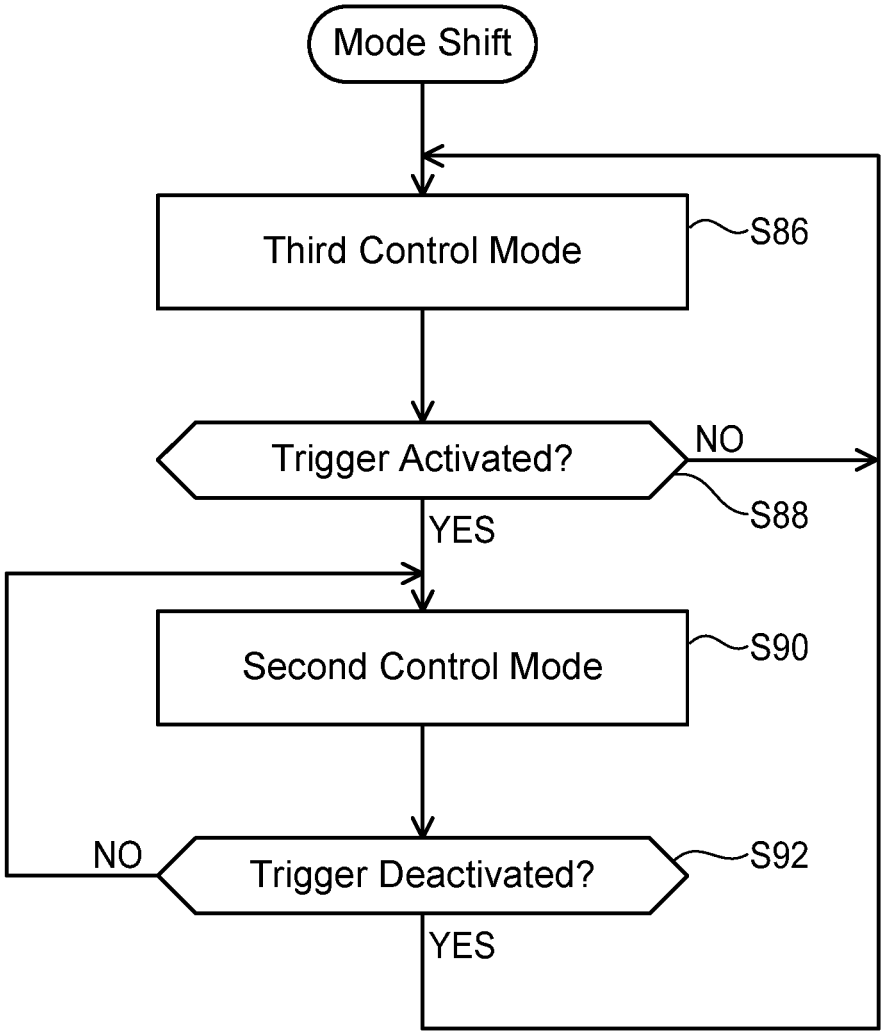
FIG. 18 is a flowchart showing an example of a process for the controller 134 to switch control modes between the second and third control modes.

FIG. 18 shows an example of a process in which the controller 134 switches the control modes in an embodiment where the second control mode and the third control mode are selectively executable. In this example, when the trigger 7 is activated (S88) the controller 134 shifts from the third control mode to the second control mode (S90), and when the trigger 7 is deactivated (S92) the controller 134 shifts from the second control mode to the third control mode (S86). That is, while the trigger 7 is deactivated the controller 134 executes the third control mode, and while the trigger 7 is activated the controller 134 executes the second control mode. Here, the, shift from the third control mode to the second control mode may take place immediately after the trigger 7 is activated, or may take place after a predetermined delay time since the trigger 7 was activated. In this embodiment, the rebar tying tool 2 does not perform the tying operation even when the user activates the trigger 7, if the rebar detection mechanism 98 does not detect the rebars R. On the other hand, when the rebar detection mechanism 98 detects the rebars R while the user activates the trigger 7, the rebar tying tool 2 performs the tying operation according to the second control mode. Further, while the trigger 7 is deactivated, the rebar tying tool 2 does not perform the tying operation even when the rebar detection mechanism 98 detects the rebars R. When the user activates the trigger 7 while the rebar detection mechanism 98 detects the rebars R, the rebar tying tool 2 performs the tying operation according to the third control mode.

Figure 19:
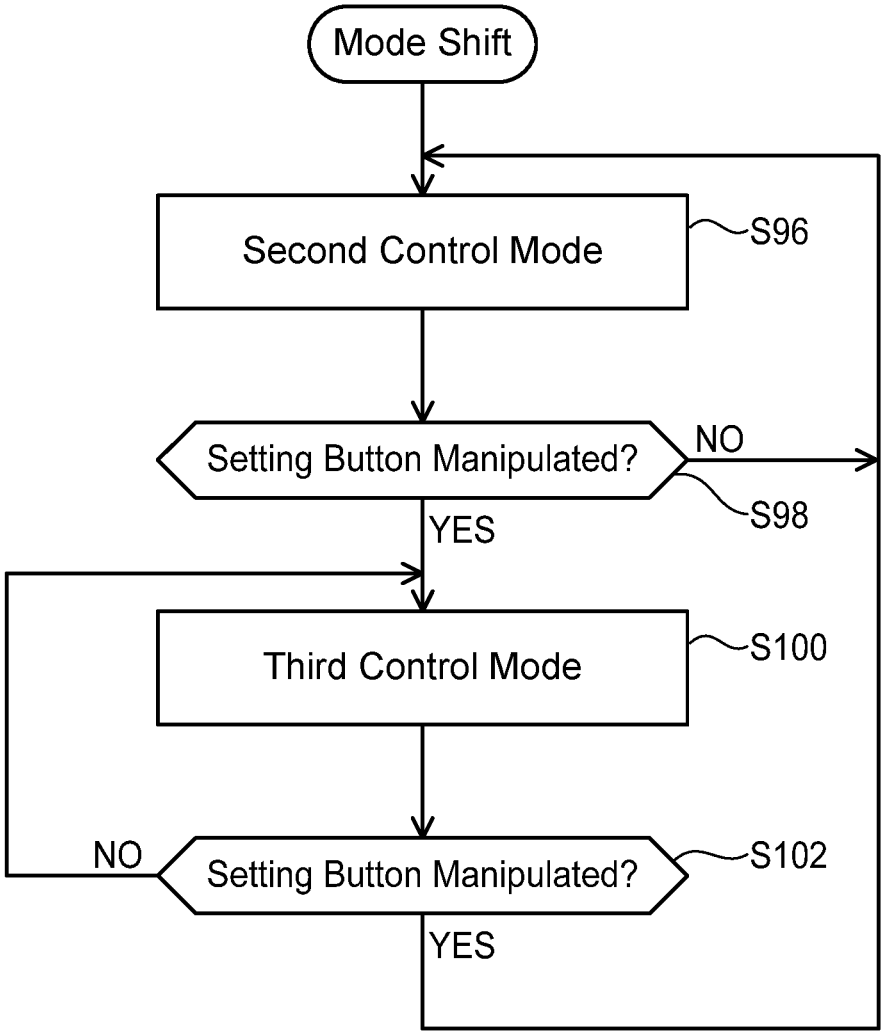
FIG. 19 is a flowchart showing an example of the process for the controller 134 to switch control modes between the second and third control modes.

FIG. 19 shows an example different from FIG. 18. In this example, when the setting buttons 26 are manipulated (S98) the controller 134 shifts from the second control mode to the third control mode (S100), and when the setting buttons 26 are manipulated again (S102) the controller 134 shifts from the third control mode to the second control mode (S96). Not limited to the setting buttons 26, the switching between the control modes may be executed by the first manipulation display 18, the second manipulation display 24, or another manipulation unit.

As above, the rebar tying tool 2 disclosed herein is provided with the tying mechanism 30, 32, 34, 36, 38, 40 and the controller 134. The tying mechanism includes at least one motor 44, 84, and is configured capable of performing the tying operation of tying the plurality of rebars R with the wire W. The controller 134 is configured to control the at least one motor to cause the tying mechanism to perform the tying operation. The controller 134 is capable of selectively executing the plurality of control modes including the first control mode and the second control mode. While the controller 134 executes the first control mode, the tying mechanism performs the tying operation when the first actuation condition is met. While the controller 134 executes the second control mode, the tying mechanism performs the tying operation when the second actuation condition different from the first actuation condition is met. According to such a configuration, the rebar tying tool can switch the actuation conditions under which the tying mechanism performs the tying operation according to the amount and content of the tying work, for example. The switching in the control modes which the controller executes may be executed according to an instruction or a manipulation by the user, or may be executed automatically by the controller. The first, second, and third control modes described above are examples, and do not limit first, second, and third control modes which the description herein intends to define.

Figure 20A:
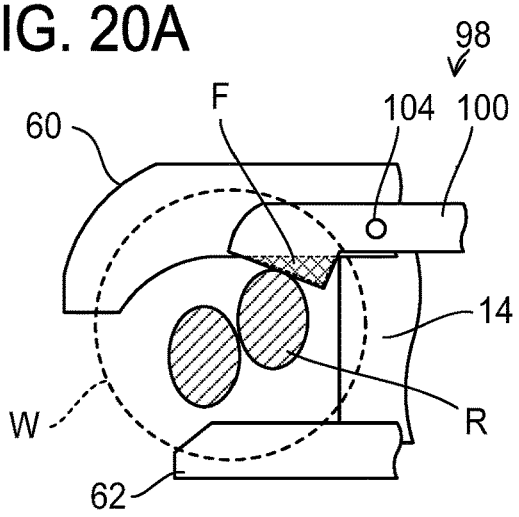
FIGS. 20A to 20F show several examples regarding a detection range F for the rebars R by the rebar detection mechanism 98.
Figure 20B:
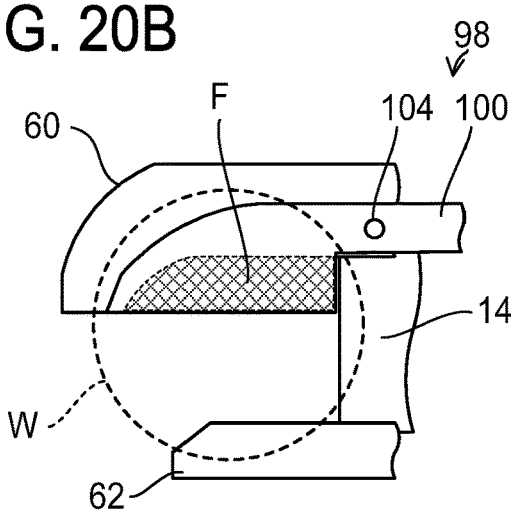
Figure 20C:
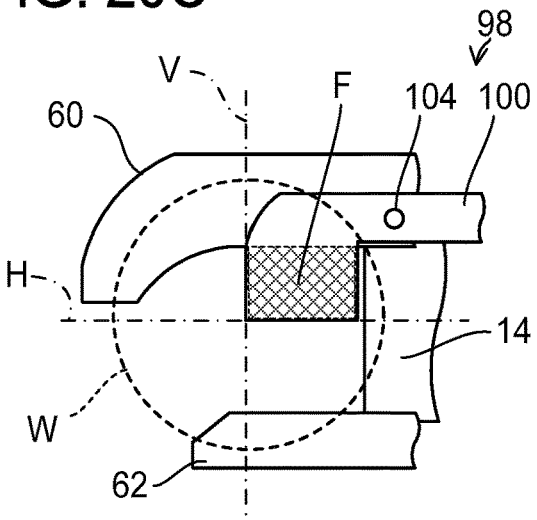
Figure 20D:
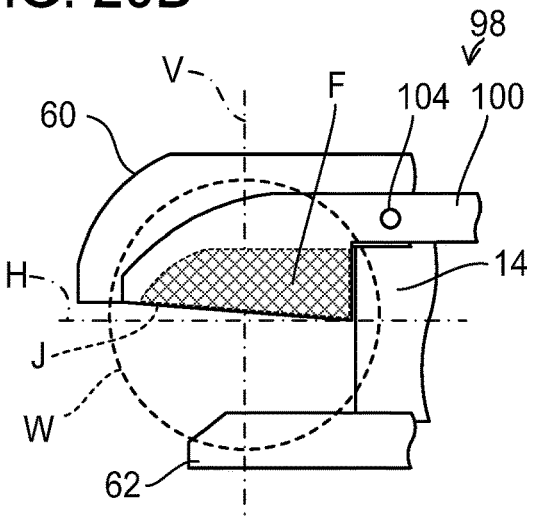

Detection ranges F in which the rebar detection mechanism 98 detects at least one of the rebars R will be described with reference to FIGS. 20A to 20F. In some of the aforementioned embodiments, as shown in FIG. 20A, the rebar detection mechanism 98 includes the contact plate 100 (or another contact member), and the rebar detection mechanism 98 detects at least one of the rebars R by the contact plate 100 coming into contact with the at least one of the rebars R, Thus, the detection range F of the rebar detection mechanism 98 coincides with a range in which the contact plate 100 protrudes from the guide arms 60, 62 in a view in a direction perpendicular to the loop-shaped wire W formed by the guide arms 60, 62 (that is, in a direction perpendicular to the first plane P shown in FIG. 7). Due to this, as shown in FIGS. 20B, 20C, 20D, and 20E, the detection range F of the rebar detection mechanism 98 can freely be changed by changing a shape of the contact plate 100 (or another contact member). Further, a position of the shaft 104 (that is, a pivot center of the contact plate 100) may be changed according to the shape of the contact plate 100 (or another contact member) such that the contact plate 100 can smoothly pivot.

Figure 20E:
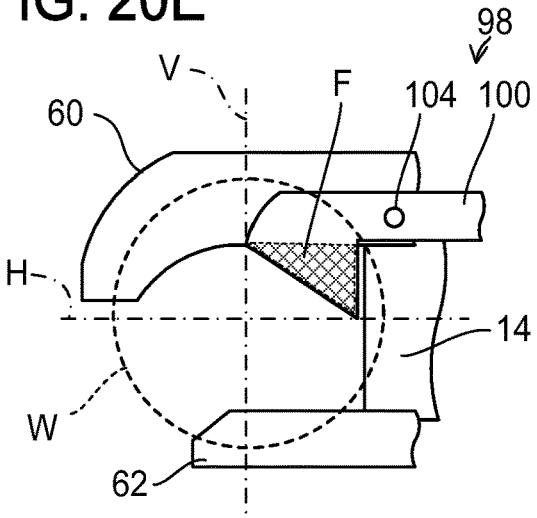
Figure 20F:
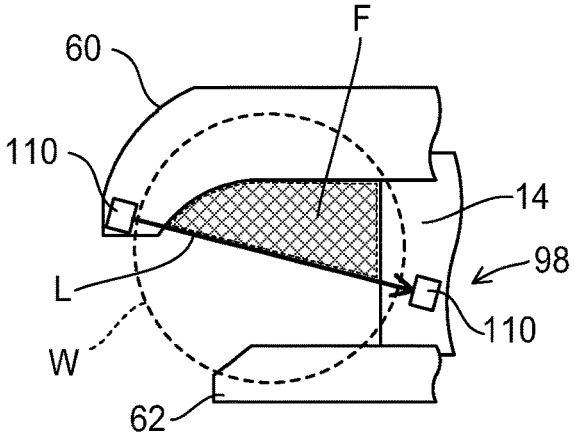

FIG. 20F shows an embodiment in which the rebar detection mechanism 98 includes noncontact sensors 110, 112 as a substitute to the contact plate 100. Although this is merely an example, the noncontact sensors 110, 112 include a light emitter 110 that linearly emits light L such as infrared, and a light receiver 112 that receives the light L. In such an embodiment, a boundary of the detection range F by the detection mechanism 98 is defined by the light L from the light emitter 110. That is, the rebar detection mechanism 98 detects the rebars when the rebars R interrupt the light L from the light emitter 110.

The detection ranges F shown in FIGS. 20A to 20F are examples, and do not particularly limit the detection range F by the rebar detection mechanism 98. In the example shown in FIG. 20B, the detection range F by the rebar detection mechanism 98 is defined wide along the upper guide arm 60. In the example shown in FIG. 20C, the detection range F by the rebar detection mechanism 98 covers a range surrounded by a vertical line V and a horizontal line H that quadrisect the loop-shaped wire W, the upper guide arm 60, and the housing (such as the left outer housing 14). In the example shown in FIG. 20D, the detection range F by the rebar detection mechanism 98 covers a range surrounded by the upper guide arm 60, a straight line J extending from the front end of the upper guide arm 60 to an intersection of the housing and the horizontal line H, and the housing. FIG. 20E has a part of the contact plate 110 cut out in a tapered shape as compared to the example shown in FIG. 20C. In the example shown in FIG. 20F, the detection range F by the rebar detection mechanism 98 is identical or similar to the detection range F in the example shown in FIG. 20D.

Although not particularly limited, in each of the examples shown in FIGS. 20A to 20F, an entirety of the detection range F by the rebar detection mechanism 98 is within the loop(s) of the wire W formed by the guide arms 60, 62 in the view in the direction perpendicular to the loop-shaped wire W formed by the guide arms 60, 62. In some other embodiments, the detection range F by the rebar detection mechanism 98 and the range surrounded by the loop-shaped wire W may coincide at least partially. Further, even in the case where the rebar detection mechanism 98 includes the noncontact sensors 110, 112 as a substitute to or in addition to the contact plate 100 (or another contact member), the detection ranges F shown in FIGS. 20A to 20E and another detection range can be defined by adjusting positions and orientations of the noncontact sensors 110, 112.

Specific examples of the present invention have been described in detail, however, these are mere exemplary indications and thus do not limit the scope of the claims. The art described in the claims includes modifications and variations of the specific examples presented above. Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

The invention claimed is:

1. A rebar tying tool configured to tie rebars with a wire, the rebar tying tool comprising:

a tying mechanism (1) configured to tie the rebars with the wire and (2) comprising a motor configured to feed the wire, a pair of guide arms configured to guide the wire fed by the motor such that the wire forms a loop extending along a first plane and surrounding the rebars when the rebars are between the pair of guide arms;

a controller configured to control the motor;

a manipulation member (1) configured for being activated and deactivated by a user and (2) operatively coupled to the controller; and a detection mechanism configured for detecting the rebars when the rebars are between the pair of guide arms, wherein the detection mechanism comprises:

a contact member configured to pivot when contacted by at least one of the rebars when the rebars are between the pair of guide arms;

a magnet disposed on or in the contact member; and a Hall effect sensor coupled to the controller and configured to detect a displacement of the magnet, the contact member comprises:

a first contact portion on a first side of the first plane and located such that the first contact portion can be contacted by the at least one of the rebars when the rebars are between the pair of guide arms;

a second contact portion on a second side of the first plane and located such that the second contact portion can be contacted by the least one of the rebars when the rebars are between the pair of guide arms, the first side and the second side are opposite sides of the first plane; and a connecting portion connecting the first contact portion and the second contact portion, the magnet being on the connecting portion, the controller is configured to selectively execute one of a plurality of control modes including a single-action control mode in which a single tying operation is performed whenever the manipulation member is activated from a deactivated state and a repetitive-action control mode in which a plurality of tying operations can be performed when the manipulation member is activated, when the controller executes the single-action control mode, the controller controls the motor to feed the wire to the pair of guide arms in response to an activation of the manipulation member by the user, and when the controller executes the repetitive-action control mode, the controller controls the motor to feed the wire to the pair of guide arms in response to a detection of the at least one of the rebars by the detection mechanism.

2. The rebar tying tool according to claim 1, wherein the controller is configured to switch the control mode to be executed according to an instruction or a manipulation by the user.

3. A rebar tying tool configured to tie rebars with a wire, comprising:

a motor configured to feed the wire;

a pair of guide arms configured to guide the wire fed by the motor such that the wire forms a loop extending along a first plane and surrounding the rebars when the rebars are between the pair of guide arms;

a trigger configured to be activated and deactivated by a user; and a detector configured to detect the rebars when the rebars are between the pair of guide arms, wherein the detector comprises:

a contact member configured to pivot when contacted by at least one of the rebars when the rebars are between the pair of guide arms;

a magnet disposed on or in the contact member; and a Hall effect sensor configured to detect a displacement of the magnet, the contact member comprises:

a first contact portion on a first side of the first plane and located such that the first contact portion can be contacted by the at least one of the rebars when the rebars are between the pair of guide arms;

a second contact portion on a second side of the first plane and located such that the second contact portion can be contacted by the at least one of the rebars when the rebars are between the pair of guide arms, the first side and the second side are opposite sides of the first plane; and a connecting portion connecting the first contact portion and the second contact portion, the magnet being disposed on the connecting portion, the motor is configured to feed the wire to the pair of guide arms when the trigger is activated by the user, and while the trigger is kept activated by the user, the motor is configured to feed the wire to the pair of guide arms when the Hall effect sensor detects the displacement of the magnet.

4. A rebar tying tool configured to tie rebars with a wire, the rebar tying tool comprising:

a motor configured to feed the wire;

a pair of guide arms configured to guide the wire fed by the motor such that the wire forms a loop extending along a first plane and surrounding the rebars when the rebars are between the pair of guide arms;

a control circuit configured to control the motor;

a trigger operatively coupled to the control circuit and configured to be activated and deactivated by a user;

a contact member pivotally supported by the pair of guide arms and comprising:

a first contact portion on a first side of the first plane and located such that the first contact portion can be contacted by at least one of the rebars when the rebars are between the pair of guide arms;

a second contact portion on a second side of the first plane and located such that the second contact portion can be contacted by the at least one of the rebars when the rebars are between the pair of guide arms; and a connecting portion connecting the first contact portion and the second contact portion;

a magnet disposed on the connecting portion; and a Hall effect sensor coupled to the control circuit and configured to detect a displacement of the magnet, wherein the control circuit is configured to selectively execute one of a plurality of control modes including a single-action control mode in which a single tying operation is performed whenever the trigger is activated from an unactivated state and a repetitive-action control mode in which a plurality of tying operations can be performed when the trigger is activated, when the control circuit executes the single-action control mode, the control circuit is configured to control the motor to feed the wire to the pair of guide arms when the trigger is activated by the user, and when the control circuit executes the repetitive-action control mode, the control circuit is configured to control the motor to feed the wire to the pair of guide arms when the Hall effect sensor detects the displacement of the magnet.

5. The rebar tying tool according to claim 4, wherein the contact member further comprises a first lever and a second lever that are parallel and spaced apart, the first contact portion is located at a first end of the first lever, the second contact portion is located a first end of the second lever, and the connecting portion extends between a second end of the first lever and a second end of the second lever.

6. The rebar tying tool according to claim 5, wherein the contact member comprises a shaft pivotally attaching the first lever and the second lever to the pair of guide arms, the first ends of the first lever and the second lever are on a first side of the shaft, and the second ends of the first lever and the second lever are on a second side of the shaft.

* * * * *